US007248220B2

(12) United States Patent
Futamata

(10) Patent No.: US 7,248,220 B2
(45) Date of Patent: Jul. 24, 2007

(54) ANTENNA

(75) Inventor: Hiromasa Futamata, Sakura (JP)

(73) Assignee: Fujikura Ltd., Tokyo (JP)

( * ) Notice: Subject to any disclaimer, the term of this patent is extended or adjusted under 35 U.S.C. 154(b) by 0 days.

(21) Appl. No.: 10/537,786

(22) PCT Filed: Dec. 5, 2003

(86) PCT No.: PCT/JP03/15588

§ 371 (c)(1),
(2), (4) Date: Jun. 6, 2005

(87) PCT Pub. No.: WO2004/054035

PCT Pub. Date: Jun. 24, 2004

(65) Prior Publication Data

US 2006/0119517 A1 Jun. 8, 2006

(30) Foreign Application Priority Data

Dec. 6, 2002 (JP) ..... 2002-354986
Mar. 20, 2003 (JP) ..... 2003-077159
Jun. 19, 2003 (JP) ..... 2003-174823

(51) Int. Cl.
*H01Q 1/38* (2006.01)

(52) U.S. Cl. ..... 343/700 MS; 343/702

(58) Field of Classification Search ..... 343/700 MS, 343/702, 767, 770
See application file for complete search history.

(56) References Cited

U.S. PATENT DOCUMENTS 5,361,488 A * 11/1994 Higashiguchi et al. ..... 29/600
6,124,831 A * 9/2000 Rutkowski et al. .. 343/700 MS
6,157,344 A 12/2000 Bateman et al. ..... 343/700 MS
6,297,779 B1 * 10/2001 Tsai ..... 343/702
6,326,912 B1 12/2001 Fujimori ..... 341/143
6,452,554 B1 * 9/2002 Aoyama et al. ..... 343/702
6,774,853 B2 * 8/2004 Wong et al. ..... 343/700 MS
2004/0008146 A1 * 1/2004 Ikegaya et al. ..... 343/767
2004/0046697 A1 * 3/2004 Tai et al. ..... 343/700 MS

FOREIGN PATENT DOCUMENTS

JP 4-44442 B2 4/1989
JP 6-177630 A 6/1994
JP 2000-068737 A 3/2000
JP 2002-271118 A 9/2002
JP 2002-280825 A 9/2002
JP 2002-299933 A 10/2002
JP 2003-101326 A 4/2003
WO WO 97/44856 A1 11/1997
WO WO 99/43037 A2 8/1999
WO WO 99/43045 A1 8/1999

OTHER PUBLICATIONS

"Film Antenna For Wireless Lan", H. Futamata et al., Fujikura Giho No. 104, published Apr. 2003.
"Development of 2.4 GHz Film Type Antenna for Mobil Devices", Morihiko Ikegaya et al., Hitachi Denson No. 21, published Jan. 2002.

* cited by examiner

*Primary Examiner*—Thuy V. Tran
*Assistant Examiner*—Dieu Hien Duong
(74) *Attorney, Agent, or Firm*—Sughrue Mion, PLLC

(57) ABSTRACT

An antenna comprises a base member (3), a ground conductor (5), a first antenna element (7) and a second antenna element (9). The base member (3) is formed in a thin plate shape and made of dielectric material. The ground conductor (5) is formed of a thin-film shaped and rectangular conductor and disposed on the base member (3). The first antenna element (7) is formed of a thin-film shaped and L-shaped conductor, is disposed on the base member (3) and has one end connected to one end (5A) of the ground conductor (5). The second antenna element (9) is formed of a thin-film shaped and rectangular conductor and is disposed on the base member (3) to be isolated from the ground conductor (5) and the first antenna element (7).

37 Claims, 24 Drawing Sheets

Y
X 1
6
9
7
7B
7C
3
13
15
9A
18
7A
17
5A
5B
5
11

Z
Y
X 7B
7
9
5
18
15
13
31
3
35B
35A
7A
17
37
39B
11
33
35
3
39
13
39A

ANTENNA

This application is a National Stage application of co-pending PCT application No. PCT/JP 03/15588 Dec. 5, 2003.

TECHNICAL FIELD

The present invention relates to antennas for use in radio communication apparatuses such as a portable telephone, PDA and wireless LAN and, more particularly, to a film antenna.

BACKGROUND ART

Recently, radio communication apparatuses such as a portable telephone, PDA (Personal Digital Assistants) and wireless LAN are daily employed. Since the radio communication apparatuses are designed on a premise that these are carried by users at all times, these apparatuses tend to be miniaturized and formed in a thin structure. With such a tendency, component parts, to be installed in the radio communication apparatuses, have similar tendencies.

In recent radio communication, there are increasing cases where a plurality of frequency bands are utilized. For example, the wireless LAN utilizes wavelengths in 2.4 GHz and 5 GHz bands. For this reason, the antennas for use in the radio communication apparatuses are required to be usable at a plurality of separate frequency bands.

A notebook-sized PC and a portable telephone use an inverted-F antenna, a dielectric antenna or a substrate antenna as built-in antenna. These antennas have features such as omnidirections and high-gains.

However, due to limited conditions in structure, it is hard to minimize the antenna in size and, especially, to form the antenna in a thin structure. When the antenna is installed in the notebook-sized PC, the antenna must be disposed in a limited area, such as a position near a hinge or a frame portion of an LCD (Liquid Crystal Display) because many of the component parts are densely located inside the notebook-sized PC.

Further, the inverted-F antenna of the related art has inherent problems listed below.

As one of the inverted-F antennas of the related art, an antenna which is disclosed in Japanese Patent Provisional Publication No. 2000-68737 has been known. The inverted-F antenna 100 is formed by folding a metallic plate 102 into a substantially U-shaped configuration as shown in FIG. 1. The inverted-F antenna 100 is available to be placed in a narrow space and can be manufactured in a low conducting loss and low cost. An inner conductor 132 of a coaxial cable 130 is electrically connected to a radiating portion 102*a* of the metallic plate 102. An outer conductor 134 of the coaxial cable 130 is electrically connected to a ground portion 102*b* of the metallic plate 102.

In order to operate the inverted-F antenna 100 in a plurality of frequency bands, an antenna 110 in which the inverted-F antenna 100 is provided with a parasitic circuit body 104 as shown in FIG. 2 has been known. The antenna 110 comprises the metallic plate 102, the parasitic circuit body 104 and a spacer 106. The parasitic circuit body 104 is disposed on an upper surface of the spacer 106. The spacer 106 is made of dielectric material (non-conductor) and inserted between the radiating portion 102*a* and the ground portion 102*b*. Under such a structure, if the inner conductor 132 of the coaxial cable 130 is electrically connected to the radiating portion 102*a* and the outer conductor 134 of the coaxial cable 130 is electrically connected to the ground portion 102*b*, the radiating portion 102*a* and the parasitic circuit body 104 generate a first resonant frequency and a second resonant frequency, respectively.

When the spacer 106 is disposed on the metallic plate 102, it is generally hard to precisely match a distance between the metallic plate 102 and the spacer 106 to a given length. For this reason, the distance between the radiating portion 102*a* and the parasitic circuit body 104 can not be accurately adjusted into a given length. As a result, the antenna 110 can not obtain accurate resonant frequencies because electrical capacitance between the radiating portion 102*a* and the parasitic circuit body 104 deviates from a given value. In a case where the resonant frequency generated by the antenna 110 increases, this problem becomes more serious.

An antenna 120 is a modified form of the antenna 110. As shown in FIG. 3, the antenna 120 has the same structure as the antenna 110 except for a shape in which a spacer 122 is different from the spacer 106. The antenna 120 is smaller than the antenna 110 because the spacer 122 is entirely accommodated in a space between the radiating portion 102*a* and the ground portion 102*b* of the metallic plate 102. However, the antenna 120 can not obtain accurate resonant frequencies because it is difficult to precisely match the distance between the radiating portion 102*a* and the parasitic circuit body 104 to a given length.

Also, the above problems arise in a case where a plurality of parasitic circuit bodies are provided to generate a plurality of resonant frequencies.

DISCLOSURE OF INVENTION

The present invention has been completed with the above view in mind and has an object to provide an antenna capable of being placed in a narrow space and of easily obtaining a plurality of accurate resonant frequencies each which belongs to a separate frequency band.

To achieve the above object, the present invention provides an antenna comprising: a thin plate-like base member made of dielectric material; a ground conductor formed of a thin-film shaped and rectangular conductor and disposed on the base member; a first antenna element formed of a thin-film shaped and L-shaped conductor, having one end connected to one end of the ground conductor and disposed on the base member; and a second antenna element formed of a thin-film shaped and rectangular conductor and disposed on the base member without being directly connected to the ground conductor and the first antenna element.

According to the present invention, the antenna can be placed in a narrow space because the film-like antenna can be manufactured by forming the ground conductor, the first antenna element and the second antenna element on the base member. If an inner conductor, an outer conductor and a sheath of a coaxial cable are connected to the first antenna element, the ground antenna element and the second antenna element, respectively, and then alternating-current electricity flows into the coaxial cable, a first resonant frequency and a second resonant frequency are generated on the first antenna element and the second antenna element, respectively. Therefore, the antenna of the present invention has a capability of easily obtaining two resonant frequencies each belonging to a separate frequency band.

To achieve the above object, the present invention provides an antenna comprising: a thin plate-like base member made of dielectric material; a first antenna element formed of a thin-film shaped conductor and disposed on the base member so as to form a slit portion opening at a part thereof;

a second antenna element formed of a thin-film and strip shaped conductor and disposed in the slit portion; and an impedance adjustment element formed of a thin-film and strip shaped conductor and disposed between one side of the first antenna element and the second antenna element in the slit portion.

According to the present invention, the antenna can be placed in a narrow space because the film-like antenna can be manufactured by forming the first antenna element, the second antenna element and the impedance adjustment element on the base member. If an inner conductor, an outer conductor and a covering material of a coaxial cable are connected to a part of the first antenna element, a part of the second antenna element and the impedance adjustment element, respectively, and then alternating-current electricity flows into the coaxial cable after impedance is adjusted by means of the impedance adjustment element, a first resonant frequency and a second resonant frequency are generated on the first antenna element and the second antenna element, respectively. Therefore, the antenna of the present invention has a capability of easily obtaining two resonant frequencies each belonging to a separate frequency band.

To achieve the above object, the present invention provides an antenna comprising: a thin plate-like base member made of dielectric material; a first antenna element formed of a thin-film shaped conductor and disposed on the base member so as to form a slit portion opening at a part thereof; and a second antenna element formed of a thin-film and strip shaped conductor and disposed in the slit portion.

According to the present invention, the antenna can be placed in a narrow space because the film-like antenna can be manufactured by forming the first antenna element and the second antenna element on the base member. If an inner conductor, an outer conductor and a sheath of a coaxial cable are connected to one part of the first antenna element, the second antenna element and another part of the first antenna element, respectively, and then alternating-current electricity flows into the coaxial cable, a first resonant frequency and a second resonant frequency are generated on the first antenna element and the second antenna element, respectively. Therefore, the antenna of the present invention has a capability of easily obtaining two resonant frequencies each belonging to a separate frequency band.

BEST MODE FOR CARRYING OUT THE INVENTION

Hereinafter, with reference to FIGS. 4 to 24, first to fourth embodiments according to antenna of the present invention are described.

FIRST EMBODIMENT

Figure 1:
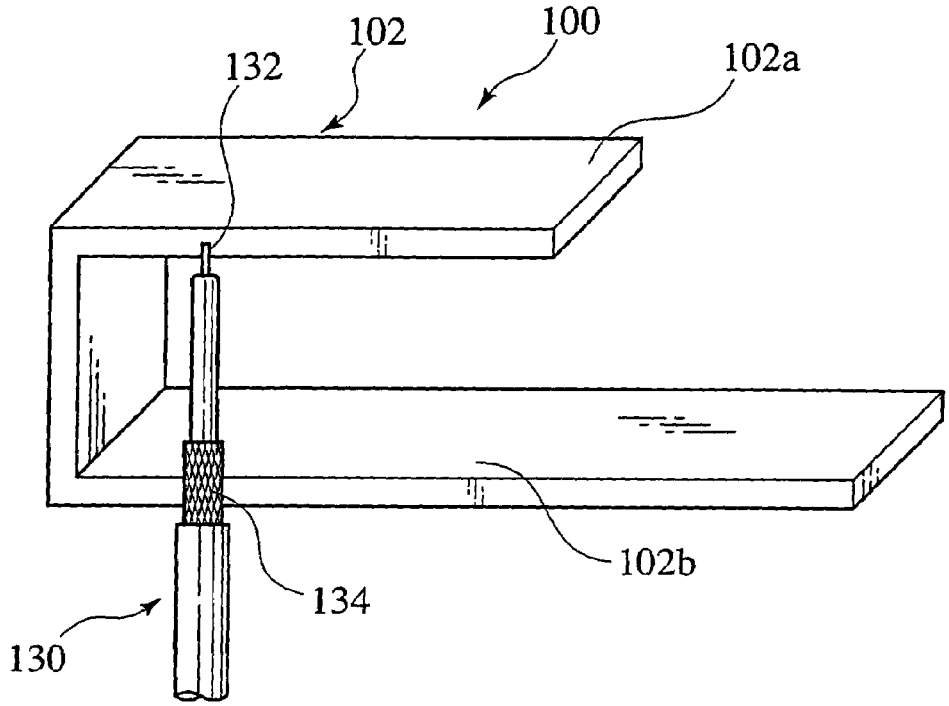
FIG.1 PRIOR ART
FIG. 1 is a perspective view showing a schematic structure of an inverted-F antenna of the related art.
Figure 2:
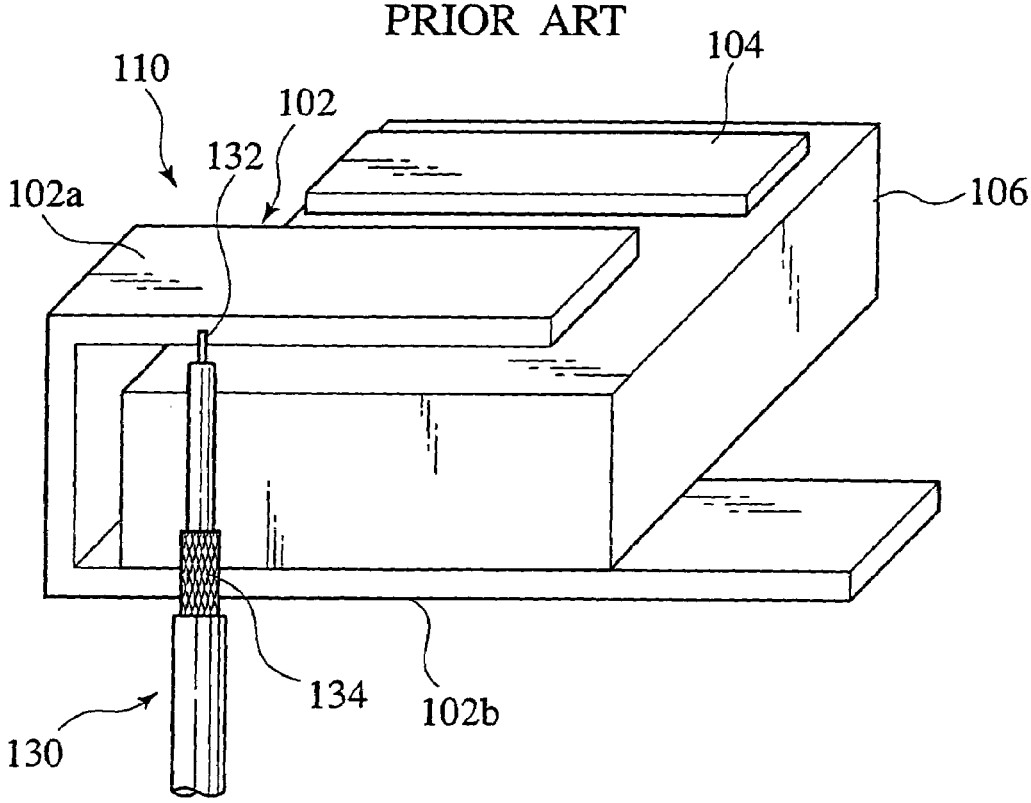
FIG.2 PRIOR ART
FIG. 2 is a perspective view showing a schematic structure of the inverted-F antenna of the related art in which a parasitic circuit body is provided.
Figure 3:
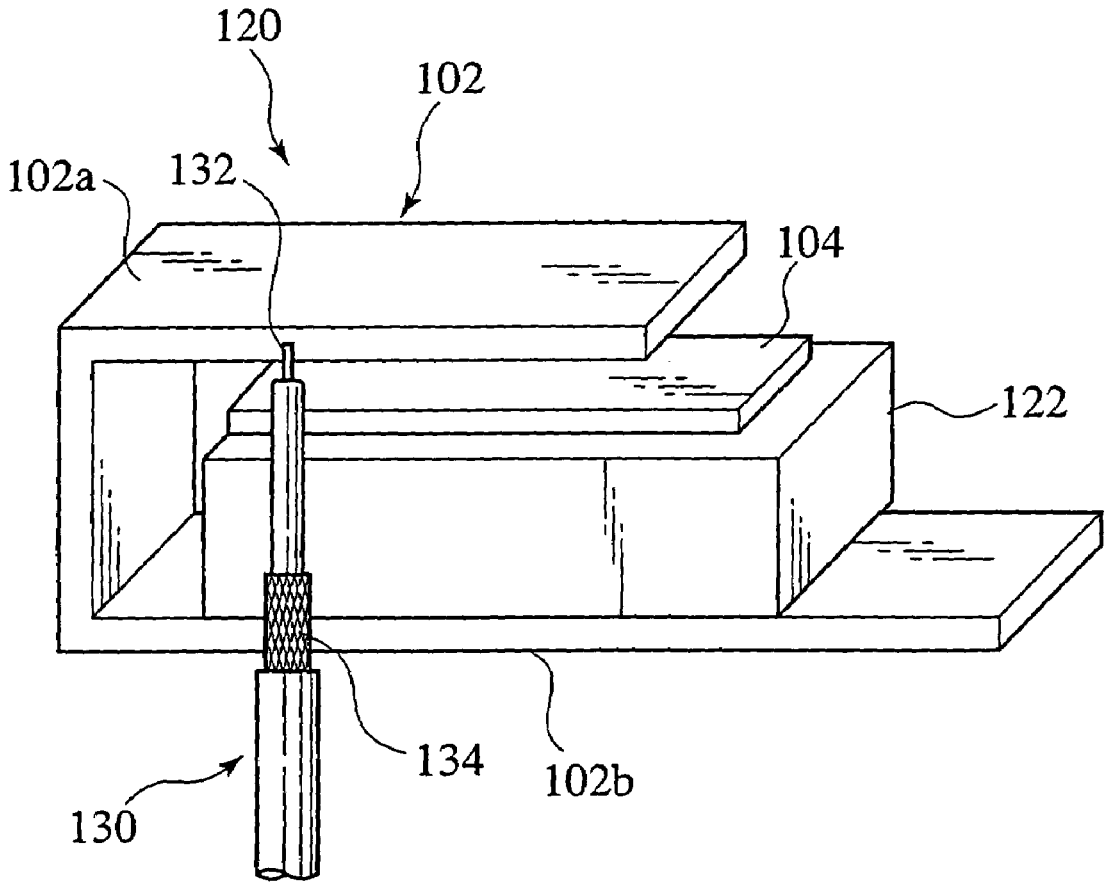
FIG.3 PRIOR ART
FIG. 3 is a perspective view showing another schematic structure of the inverted-F antenna of the related art in which a parasitic circuit body is provided.
Figure 4:
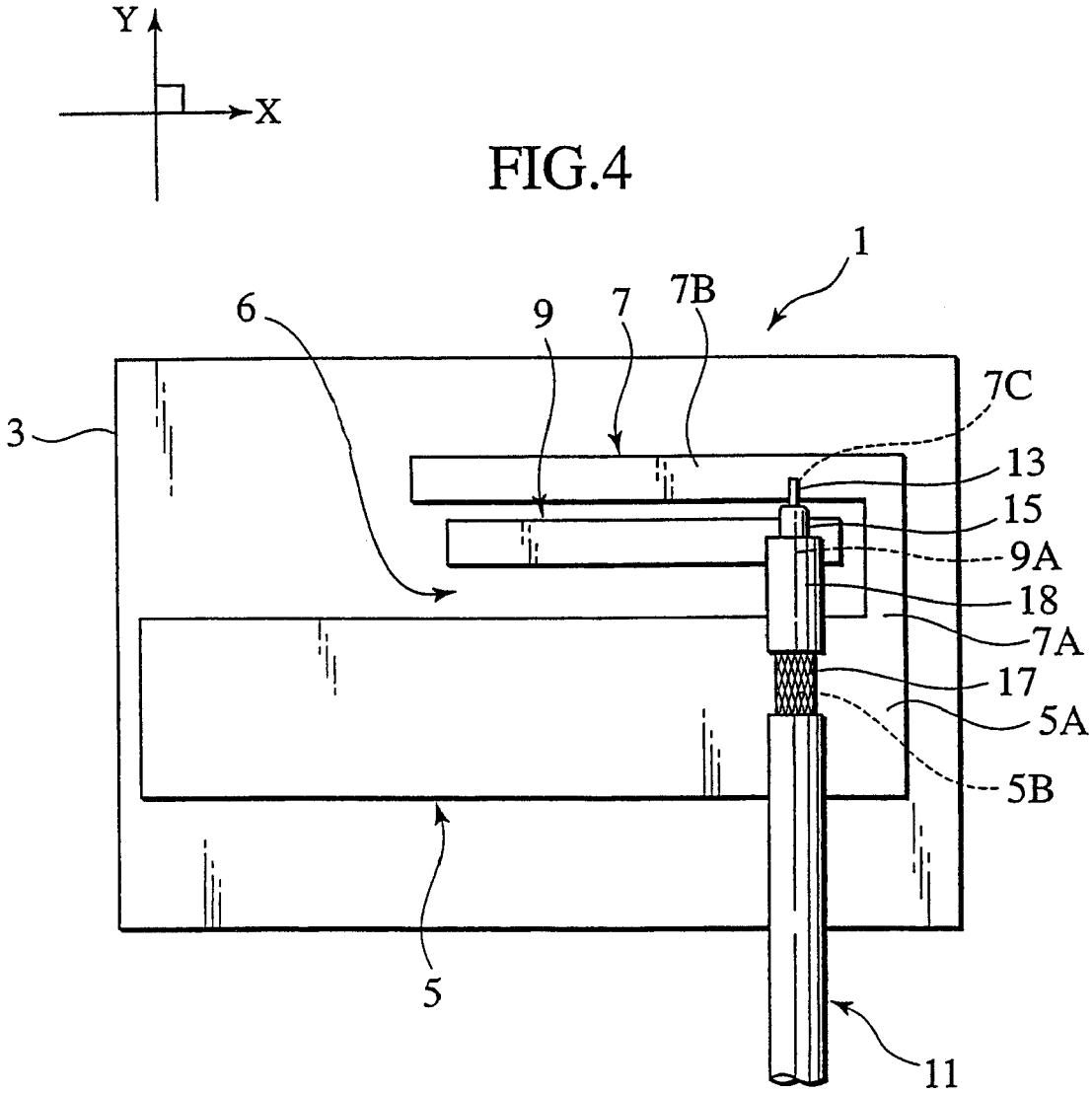
FIG. 4 is a plan view of a two-resonance antenna according to a first embodiment of the present invention.

FIG. 4 is a plan view of a two-resonance antenna 1. In the present embodiment, a major axis and a minor axis of a base member 3 are assigned to an X-axis and a Y-axis, respectively, and the X-axis and Y-axis perpendicularly cross each other.

The two-resonance antenna 1 is a monopole antenna formed in a film shape and comprises a base member 3, a ground conductor 5, a first antenna element 7 and a second antenna element 9. The base member 3 is formed of a rectangular thin plate with flexibility and is made of dielectric material such as resin of a polyamide system. The ground conductor 5, the first antenna element 7 and the second antenna element 9 are formed on a surface of the base member 3. The ground conductor 5, the first antenna element 7 and the second antenna element 9 take the forms of conductors each which is formed in a thin film shape and is made of metal such as beaten-copper.

The ground conductor 5 is formed along the X-axis and serves as a rectangular grand surface in the monopole antenna. In order to generate electric images of the first antenna element 7 and the second antenna element 9 on the ground conductor 5, the ground conductor 5 has a larger surface area than those of the first antenna element 7 and the second antenna element 9.

The first antenna element 7 is formed in an L-shaped configuration with two combined rectangular conductors (including a short-circuited portion 7A and a radiating portion 7B). The short-circuited portion 7A of the first antenna element 7 is connected to one end 5A of the ground conductor 5. The radiating portion 7B of the first antenna element 7 is shorter than the ground conductor 5 and is disposed in parallel to the ground conductor 5. With such a layout, a slit portion 6 having an open at one end thereof is formed on the base member 3.

Although the first antenna element 7 of the present embodiment has the layout in which the short-circuited portion 7A is perpendicularly contiguous with the radiating portion 7B, the present invention is not limited to such a layout and may take a contiguous configuration in an obtuse angle or an acute angle. Also, although the first antenna element 7 of the present embodiment has the layout in which a side wall of the short-circuited portion 7A is formed in a straight-line configuration, the present invention is not limited to such a layout and may take a configuration formed in a circular arc. When the side wall of the short-circuited portion 7A is formed in the circular arc configuration, the ground conductor 5 and the first antenna element 7 form a conductor in a substantially U-shaped configuration on the base member 3.

The second antenna element 9 is formed in a rectangular shape. The second antenna element 9 is disposed in the slit portion 6 so as to lie in parallel to the ground conductor 5 and the radiating portion 7B of the first antenna portion 7. The second antenna 9 is shorter than the ground conductor 5 and the radiating portion 7B of the first antenna portion 7.

Figure 5:
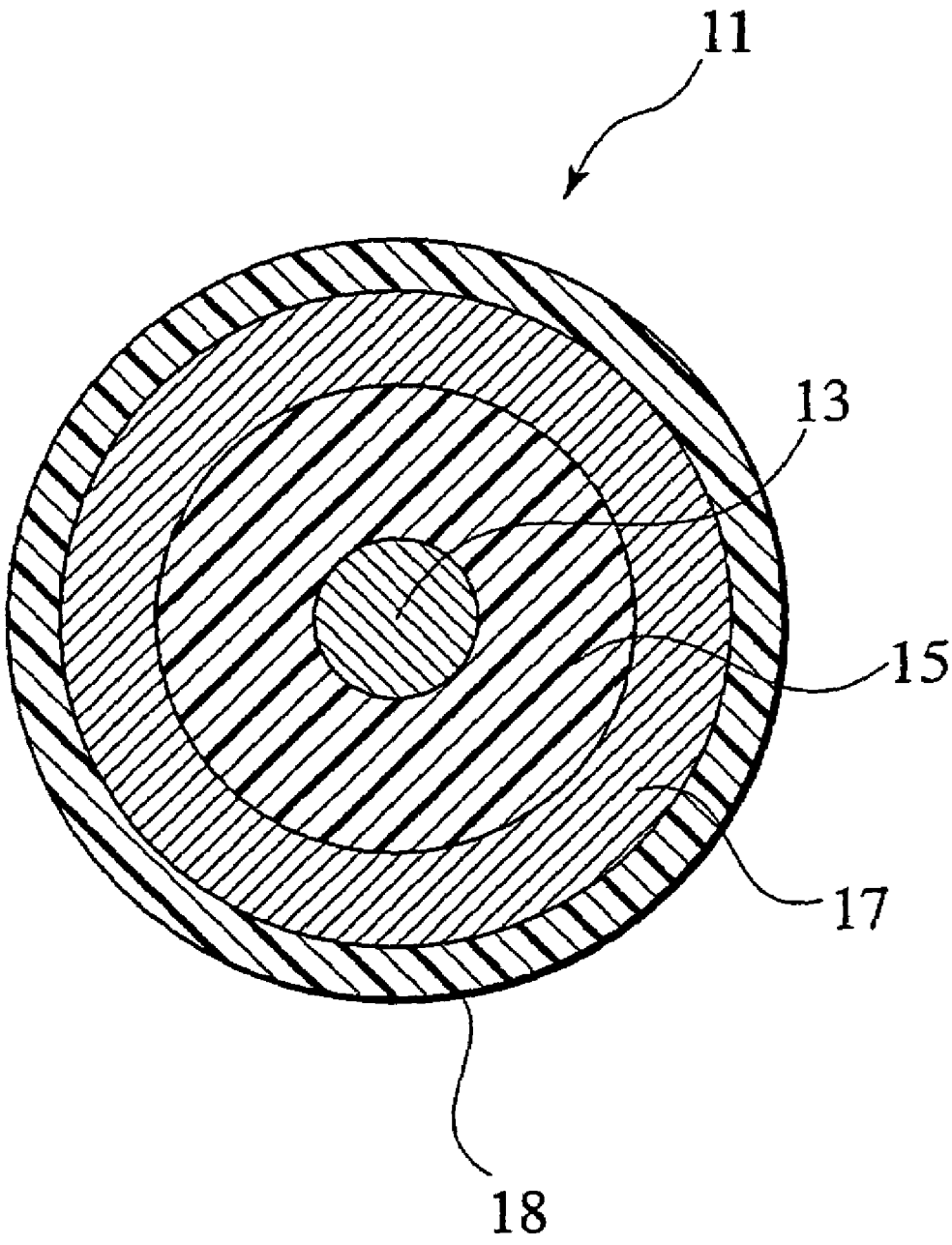
FIG. 5 is a cross sectional view of a coaxial cable according to the first embodiment of the present invention.

FIG. 5 is a cross sectional view of a coaxial cable 11. The coaxial cable 11 comprises a center conductor 13, a covering material 15, an outer conductor 17 and a sheath 18. The center conductor 13 is covered with the covering material 15. The outer conductor 17 is disposed around an outer periphery of the covering material 15 and is covered with the sheath 18 which is made of insulation material (dielectric material). The sheath 18 serves to protect the outer conductor 17 and isolate the outer conductor 17 from an outside of the coaxial cable 11.

As shown in FIG. 4, a first connecting portion 7C is formed on a part of the radiating portion 7B of the first antenna portion 7 in order to electrically connect the first antenna element 7 to the center conductor 13 of the coaxial cable 11 by direct-current electricity. A contact portion 9A is formed on a part of the second antenna portion 9 in order to electrically connect the second antenna element 9 to the outer conductor 17 of the coaxial cable 11 by alternating-current electricity via the sheath 18 of the coaxial cable 11. A second connecting portion 5B is formed on a part of the ground conductor 5 in order to electrically connect the ground conductor 5 to the outer conductor 17 of the coaxial cable 11 by direct-current electricity. The first connecting portion 7C, the second connecting portion 5B and the contact portion 9A are located on a straight line along the Y-axis.

The center conductor 13 exposed at a terminal portion of the coaxial cable 11 is connected to the first connecting portion 7C by soldering. Removing the sheath 18 by a given length in a longitudinal direction of the coaxial cable 11 allows the outer conductor 17, exposed on the coaxial cable 11, to be connected to the second connecting portion 5B by soldering. The outer conductor 17 covered with the sheath 18 is fixed to the contact portion 9A by contact or an adhesive. Since the outer conductor 17 is not directly connect to the second antenna element 9, no electric current flows between the second antenna element 9 and the outer conductor 17 even when applied with direct-current electricity. With such a structure, there is no need to separately provide a particular member for avoiding the second antenna element 9 and the outer conductor 17 from directly contacting each other, resulting in the two-resonance antenna 1 with a simplified structure.

The second antenna element 9 is isolated from the center conductor 13 of the coaxial cable 11, the outer conductor 17 of the coaxial cable 11, the first antenna element 7 and the ground conductor 5. However, the second antenna element 9 is capacitively coupled with the ground conductor 5 and the first antenna element 7 through the base member 3 made of dielectric material. Further, the second antenna element 9 is capacitively coupled with the outer conductor 17 of the coaxial cable 11 via the sheath 18. This arrangement is equivalent to an arrangement in which the second antenna element 9 is connected to the ground conductor 5, the first antenna element 7 and the outer conductor 17 via a capacitor. Accordingly, if alternating-current electricity is applied to the center conductor 13 of the coaxial cable 11, electric current flows between the ground conductor 5 and the second antenna element 9, between the first antenna element 7 and the second antenna element 9 and between the second antenna element 9 and the outer conductor 17. Here, it is noted that electric current flowing between the ground conductor 5 and the second antenna element 9 almost never contributes to resonance of the second antenna element 9.

In order to adjust electrical capacitance between the contact portion 9A and the outer conductor 17, a film-shaped dielectric member may be disposed between the sheath 18 and the contact portion 9A. This dielectric member allows a resonant frequency, which would be generated on the second antenna element 9, to be easily adjusted.

Next, a resonance principle of the two-resonance antenna 1 is described below.

First resonance of the two-resonance antenna 1 is generated by electric current distributed on the first antenna element 7. Namely, this resonance is generated by a first inverted-F antenna formed of the first antenna element 7. A resonance principle of the first inverted-F antenna is the same as that of a λ/4 monopole antenna. A length of the first antenna element 7 is about one fourth of the wavelength of the first inverted-F antenna. Impedance matching which causes the first inverted-F antenna to generate the resonant frequency is carried out by changing a connecting position of the center conductor 13 of the coaxial cable 11.

Second resonance of the two-resonance antenna 1 is generated by electric current distributed on the second antenna element 9 and outer conductor 17 of the coaxial cable 11. Namely, this resonance is generated by a second inverted-F antenna formed of the second antenna element 9 and the outer conductor 17. A resonance principle of the second inverted-F antenna is the same as that of a λ/2 antenna. If alternating-current electricity is supplied from the center conductor 13 of the coaxial cable 11 to the first antenna element 7, first electric current flows on the second antenna element 9 because the first antenna element 7 is capacitively coupled with the second antenna element 9. The first electric current is distributed on the second antenna element 9. Second electric current flows on the outer conductor 17 because the second antenna element 9 is capacitively coupled with the outer conductor 17. The second electric current flows to a GND surface of the ground conductor 5 through the second connecting portion 5B. A total length given by adding a length of the second antenna element 9 to a length between the contact portion 9A and the second connecting portion 5B in the outer conductor 17 is about one second of the wavelength of the second inverted-F antenna. Impedance matching which causes the second inverted-F antenna to generate the resonant frequency is carried out by changing a thickness of the sheath 18 intervening between the second antenna element 9 and the outer conductor 17. Therefore, in the second inverted-F antenna, it is important not to electrically contact the second antenna element 9 to the outer conductor 17 by means of the insulation layer such as the sheath 18.

Figure 6:
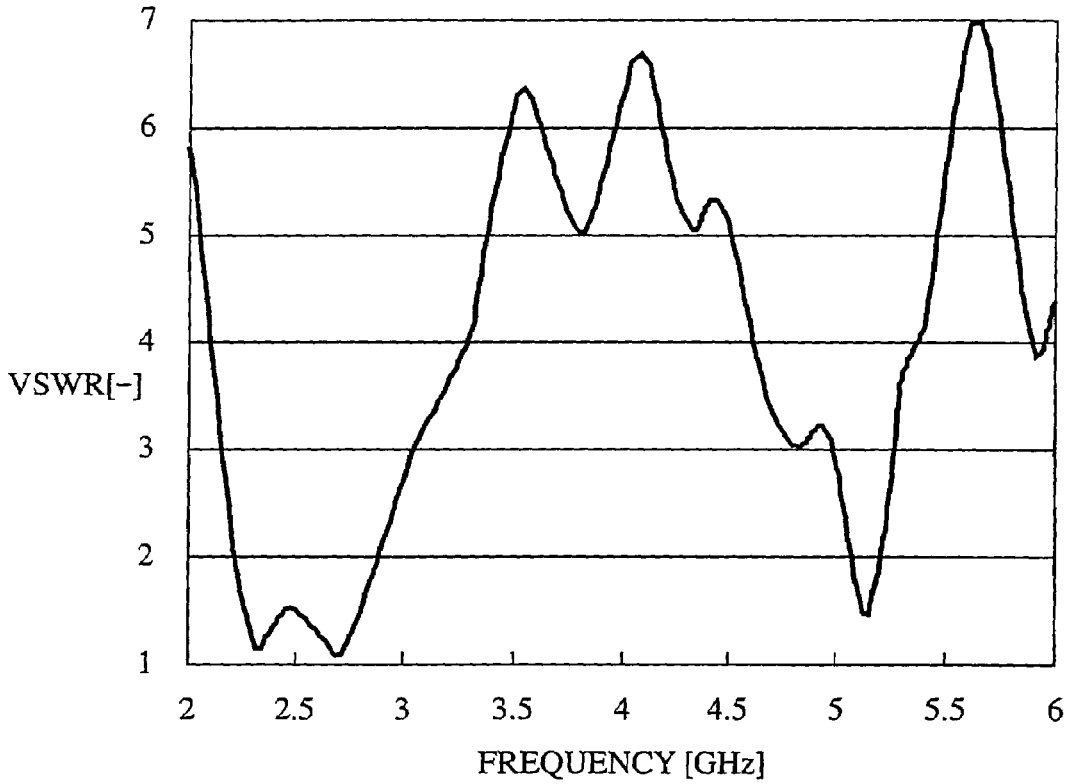
FIG. 6 is a view illustrating a VSWR characteristic of the two-resonance antenna according to the first embodiment of the present invention.
Figure 7B:
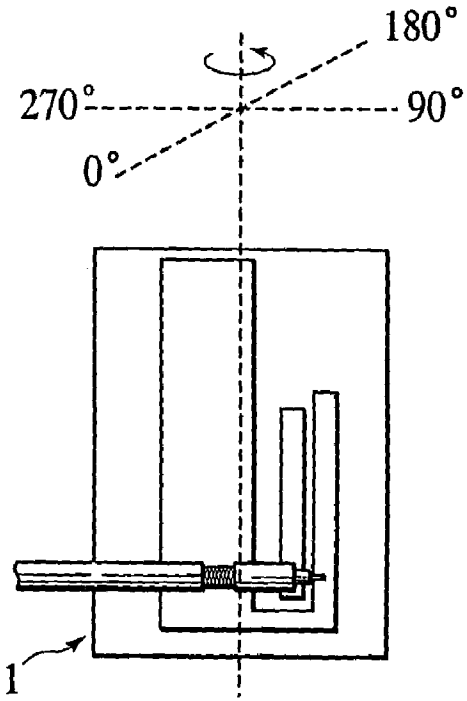
FIG. 7B is a view illustrating a rotative direction of the two-resonance antenna according to the first embodiment in FIG. 7A.
Figure 7A:
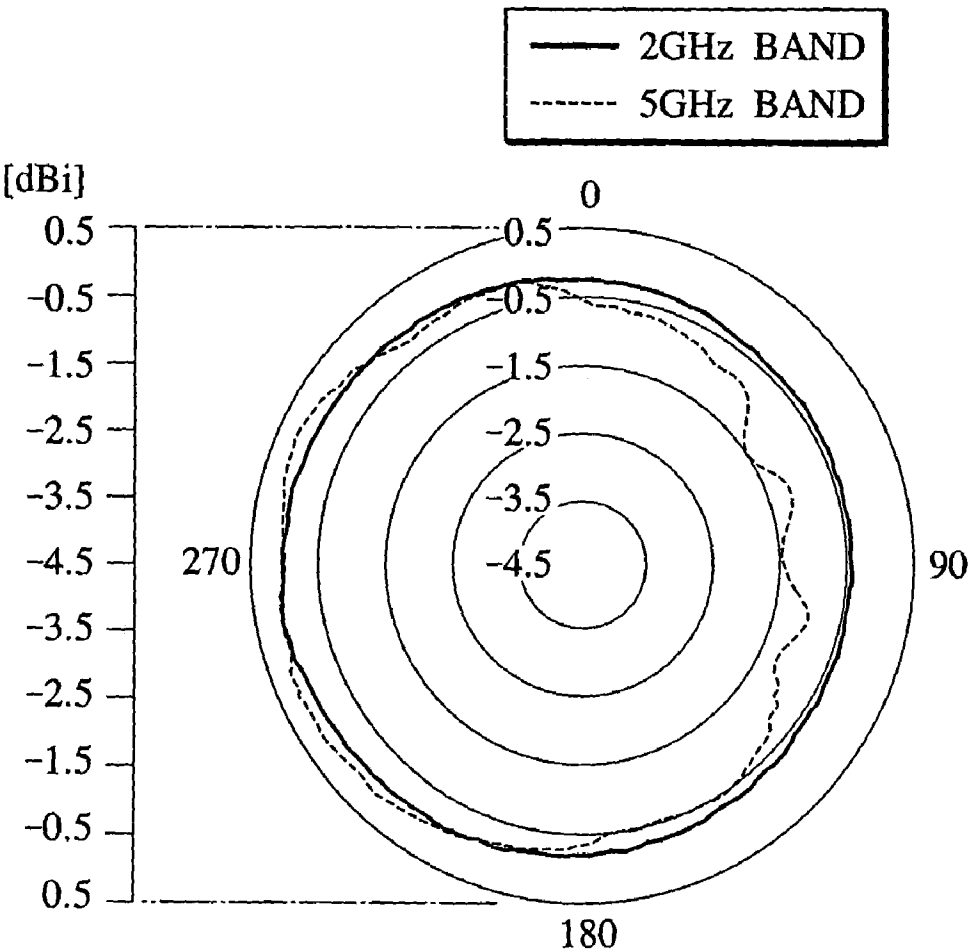
FIG. 7A is a view illustrating a radiating characteristic of the two-resonance antenna according to the first embodiment of the present invention.

The two-resonance antenna 1 has a VSWR characteristic shown in FIG. 6 and a radiating characteristic shown in FIG. 7A.

The VSWR (Voltage Standing Wave Ratio) is described below in detail. In a state of connecting an electric power supply line to the antenna, when alternating-current electricity flows in the electric power supply line, electric current flows on the antenna. Voltage vibration generated on the electric power supply line by the electric current is termed a progressive wave. If there is a difference between a characteristic impedance of the electric power supply line and a characteristic impedance of the antenna, electric current is reflected at a point where the electric power supply line is connected to the antenna, which causes some of the electric current to return to a transmission side. Voltage vibration generated on the electric power supply line by the returned electric current is termed a reflected wave. In general, if there is the reflected wave on the electric power supply line, an electric power loss occurs at the point where the electric power supply line is connected to the antenna. Therefore, the characteristic impedance of the electric power supply line and the characteristic impedance of the antenna are mutually adjusted so as to have the same values to suppress a generation of reflected wave as less as possible. If there are the progressive wave and the reflected wave on the electric power supply line, two waves are synthesized to form a standing wave. A ratio between the maximum amplitude and the minimum amplitude of the standing wave is termed VSWR. The VSWR and a power loss rate (reflected power) R are respectively defined by Eqs. (2) and (3) by using a reflection coefficient |Γ| defined by Eq. (1).

$$\Gamma=(Zi-Z0)/(Zi+Z0) \quad (1)$$

$$VSWR=(1+|\Gamma|)/(1-|\Gamma|) \quad (2)$$

$$R=|\Gamma|^2\times 100 \quad (3)$$

where Zi is the characteristic impedance of a line (electric power supply line), and Z0 is the characteristic impedance of a load (antenna).

For example, if the coaxial cable 11 with 50 Ω resistor is connected to a dipole antenna with 75 Ω resistor, |Γ|=0.2, VSWR=1.5 and R=4 are derived from the above Eqs. Accordingly, electric power is reflected at a rate of 4% from an electric power supply point of an antenna.

If the characteristic impedance of the electric power supply line and the characteristic impedance of the antenna have the same values, the reflection coefficient and the VSWR have the values of 0 and 1, respectively. In this case, the reflection loss of the electric power does not occur at the electric power supply point because the electric power reflection has the value of 0. From Eqs. (2) and (3), if the value of the VSWR becomes larger, the reflection loss of the electric power becomes larger at the electric power supply point. From the reasons discussed above, in fabrication of the antenna, the characteristic impedance of the electric power supply line and the characteristic impedance of the antenna are adjusted such that the VSWR has the value of 1 as close as possible.

In FIG. 6, there are two band widths appearing at two regions with a frequency in which the VSWR has a value less than "2". One of these regions lies in a value ranging from 2.2 GHz to 2.9 GHz. The other of these regions lies in a value ranging from 5.1 GHz to 5.2 GHz. Accordingly, the band widths correspond to a range of approximately 700 MHz at 2 GHz band and to a range of approximately 100 MHz at 5 GHz band.

Next, the radiating characteristic is described below in detail. The electric power supplied from the electric power supply line is lost in the form of heat which is generated by the material forming the antenna before the electric wave is radiated. Also, depending on the shape of the antenna, a radiating pattern of the antenna varies. Therefore, in order to understand a performance of the antenna, the electric power loss (a gain availability) and the radiating pattern (a directivity) of the antenna are grasped by researching gains of the antenna in an omnidirectional range while the antenna is rotated as shown in FIG. 7B.

As shown in FIG. 7A, in 2 GHz and 5 GHz bands, vertical polarized waves forming main polarized waves have shapes nearly equal to circular configurations and have high-gain availabilities. Accordingly, the two-resonance antenna 1 has omnidirection and high-gain availability that are desired characteristics of the antenna.

The two-resonance antenna 1 has advantageous features listed below.

The first resonant frequency and the second resonant frequency can be freely set to arbitrary values, respectively, because the first antenna element 7 on which the first resonant frequency is generated and the second antenna element 9 on which the second resonant frequency is generated are disposed to be independent from each other. For example, both resonant frequencies can be adjusted such that a difference between the first resonant frequency and the second resonant frequency increases.

Impedance adjustment between the two-resonance antenna 1 and the coaxial cable 11 can be easily performed because the first connecting portion 7C, the second connecting portion 5B and the contact portion 9A can be set to respective positions independent from one another.

The coaxial cable 11 can be easily fixed to the two-resonance antenna 1 because the first connecting portion 7C, the second connecting portion 5B and the contact portion 9A are disposed on the surface of the base member 3. In addition, the coaxial cable 11 can be easily fixed to the two-resonance antenna 1 without bending because the first connecting portion 7C, the second connecting portion 5B and the contact portion 9A are linearly located.

The antenna can be realized in a miniaturized and thin structure because the two-resonance antenna 1 is fabricated by combining the L-shaped first antenna element 7 and the rectangular ground conductor 5, forming the slit portion 6 which opens at one end thereof, and locating the rectangular second antenna element 9 in the slit portion 6.

Electrical capacitances between the second antenna element 9 and the first antenna element 7 and between the second antenna element 9 and the ground conductor 5 can be easily ensured such that they have respective large values because the second antenna element 9 is formed in an elongated state in substantially parallel to and along the first antenna element 7 and the ground conductor 5 and is formed inside the first antenna element 7 and the ground conductor 5.

Noises occurring in the two-resonance antenna 1 are absorbed by the outer conductor 17 because the coaxial cable 11 in which the outer conductor 17 is disposed around the center conductor 13 is employed as the electric power supply line for the antenna. Accordingly, the two-resonance antenna 1 is hard to suffer from an adverse affect caused by the noises.

A simplification in an antenna structure and reduction in manufacturing cost can be realized because the two-resonance antenna 1 is manufactured by forming the first antenna element 7 and the second antenna element 9 in thin film metallic elements on the surface of the base member 3 made of the dielectric material of the polyamide system.

As one of manufacturing methods of the two-resonance antenna 1, the two-resonance antenna 1 may be manufactured by means of an etching technique by using CCL and a screen printing technique. According to this method, a shape of the ground conductor 5, a shape of the first antenna element 7, a shape of the second antenna element 9, a relative position between the ground conductor 5 and the second antenna element 9, and a relative position between the first antenna element 7 and the second antenna element 9 can be precisely fixed on the base member 3 because the ground conductor 5, the first antenna element 7 and the second antenna element 9 are formed on the base member 3 in a single step. Consequently, electrical capacitances between the ground conductor 5 and the second antenna element 9 and between the first antenna element 7 and the second antenna element 9 can be maintained in respective accurate values, and it is possible to perform mass production of the two-resonance antenna 1 within a short period of time. Also, reduction in a pre-investment and flexibility in shape of the antenna can be realized because no metal mold is required for manufacturing the two-resonance antenna 1.

Next, a method for installing the two-resonance antenna 1, as an antenna for a wireless LAN compatible with two-frequencies, on a notebook-sized PC 19 is described below.

Figure 8:
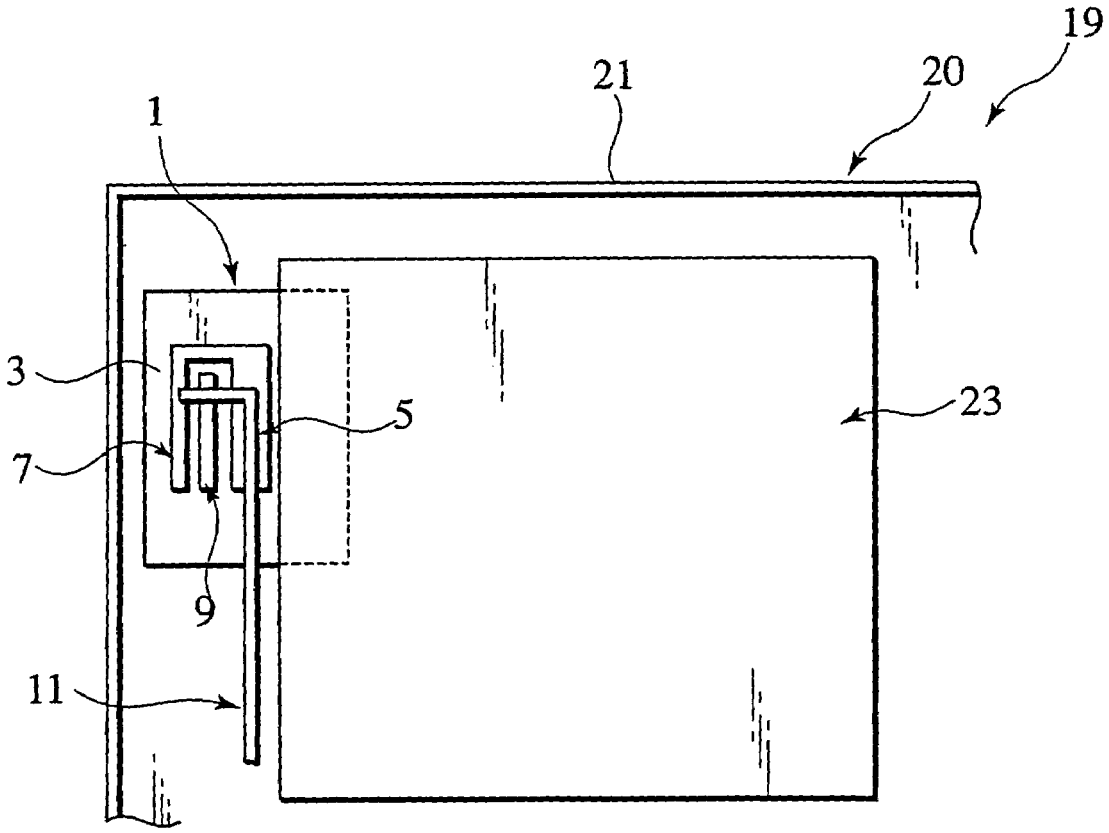
FIG. 8 is a schematic illustrative view of the two-resonance antenna according to the first embodiment of the present invention mounted on an LCD section of a notebook-sized PC.

As shown in FIG. 8, when the two-resonance antenna 1 is mounted on an LCD section 20 of the notebook-sized PC 19, a portion of the base member 3 of the two-resonance antenna 1 is superposed on a rear wall of an LCD panel 23, and the two-resonance antenna 1 is fixedly secured to a frame portion of the LCD section 20 through an two-sided tape. In general, in order to form the notebook-sized PC 19 in a thin structure, the LCD section 20 is designed to be extremely thin. Since a thickness of the two-resonance antenna 1 is extremely thin in the order of approximately 100 μm, there is not a problem that the thickness of the LCD section 20 increases by placement of the two-resonance antenna 1.

Figure 9:
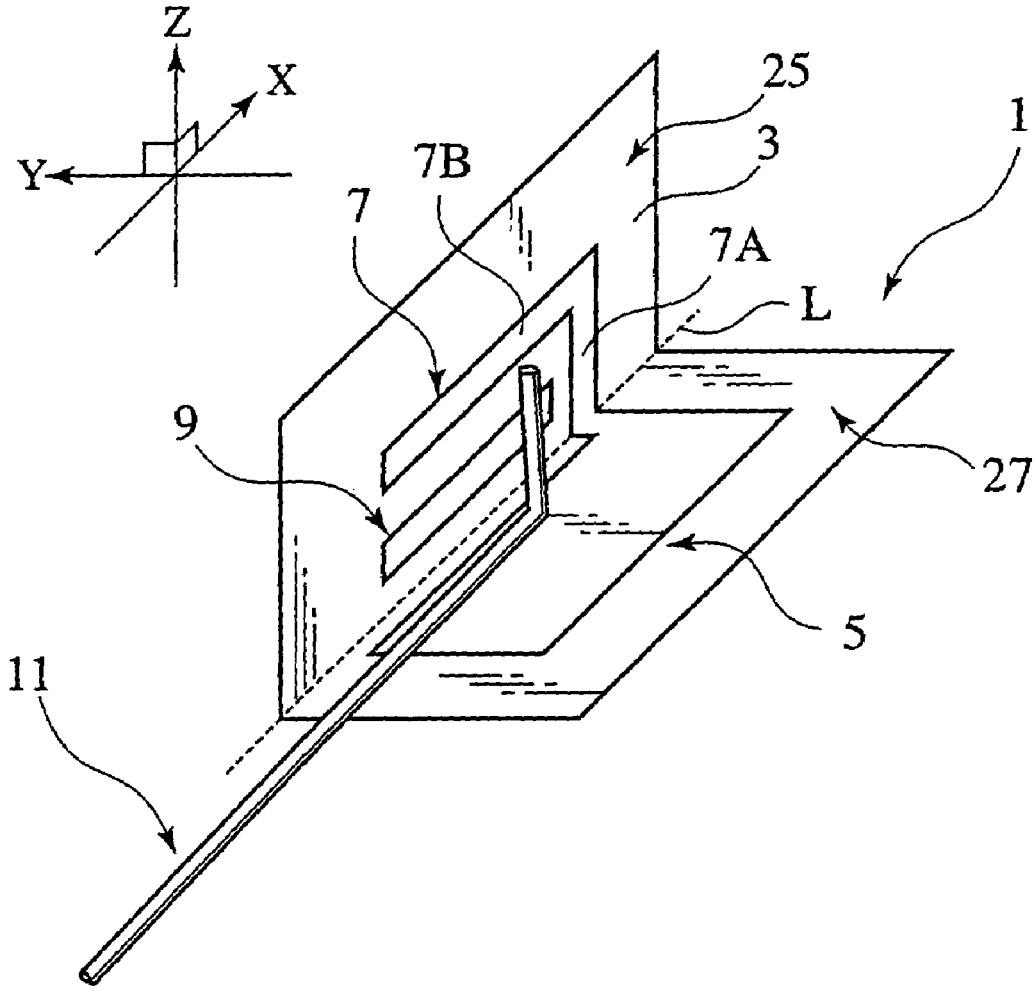
FIG. 9 is a perspective view of the two-resonance antenna according to the first embodiment of the present invention in a folded status.
Figure 10:
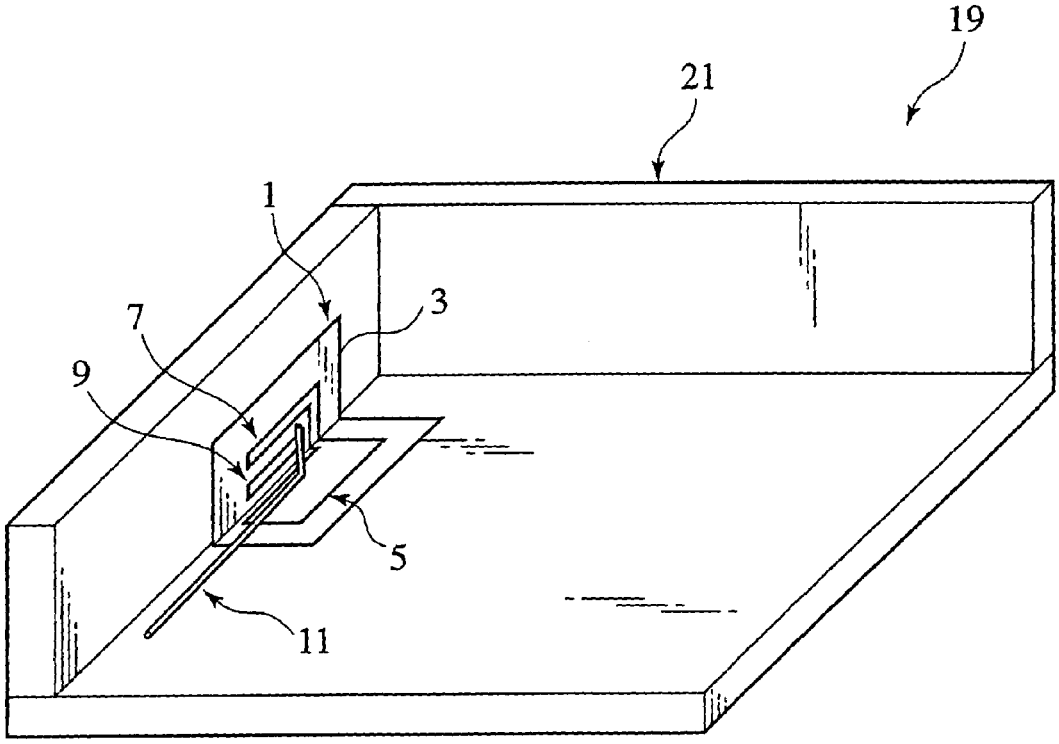
FIG. 10 is a perspective view of the two-resonance antenna shown in FIG. 9 mounted on a corner area of a case of the notebook-sized PC.

As shown in FIG. 10, in a case where the two-resonance antenna 1 is mounted on a corner area of a casing 21 of the notebook-sized PC 19, the two-resonance antenna 1 is folded and then secured to the corner area of the casing 21 of the notebook-sized PC 19 through a two-sided tape. Since the two-resonance antenna 1 is a basal plate composed of the base member 3 which is thin and has flexibility, the antenna can be folded. In particular, as shown in FIG. 9, the base member 3 is divided into a vertical section 25 and a horizontal section 27 with respect to a line segment L, and the vertical section 25 vertically extends in a direction along the +Z-axis with respect to the horizontal section 27. The vertical section 25 includes one part of the short-circuited portion 7A of the first antenna element 7, the radiating portion 7B of the first antenna element 7 and the second antenna element 9. The horizontal section 27 includes the other part of the short-circuited portion 7A of the first antenna element 7 and the ground conductor 5. With such a structure, the two-resonance antenna 1 can be located at the corner area of the casing 21 of the notebook-sized PC 19.

Next, a method for applying the two-resonance antenna 1 to a support member 33, as a two-resonance antenna device, is described.

Figure 11:
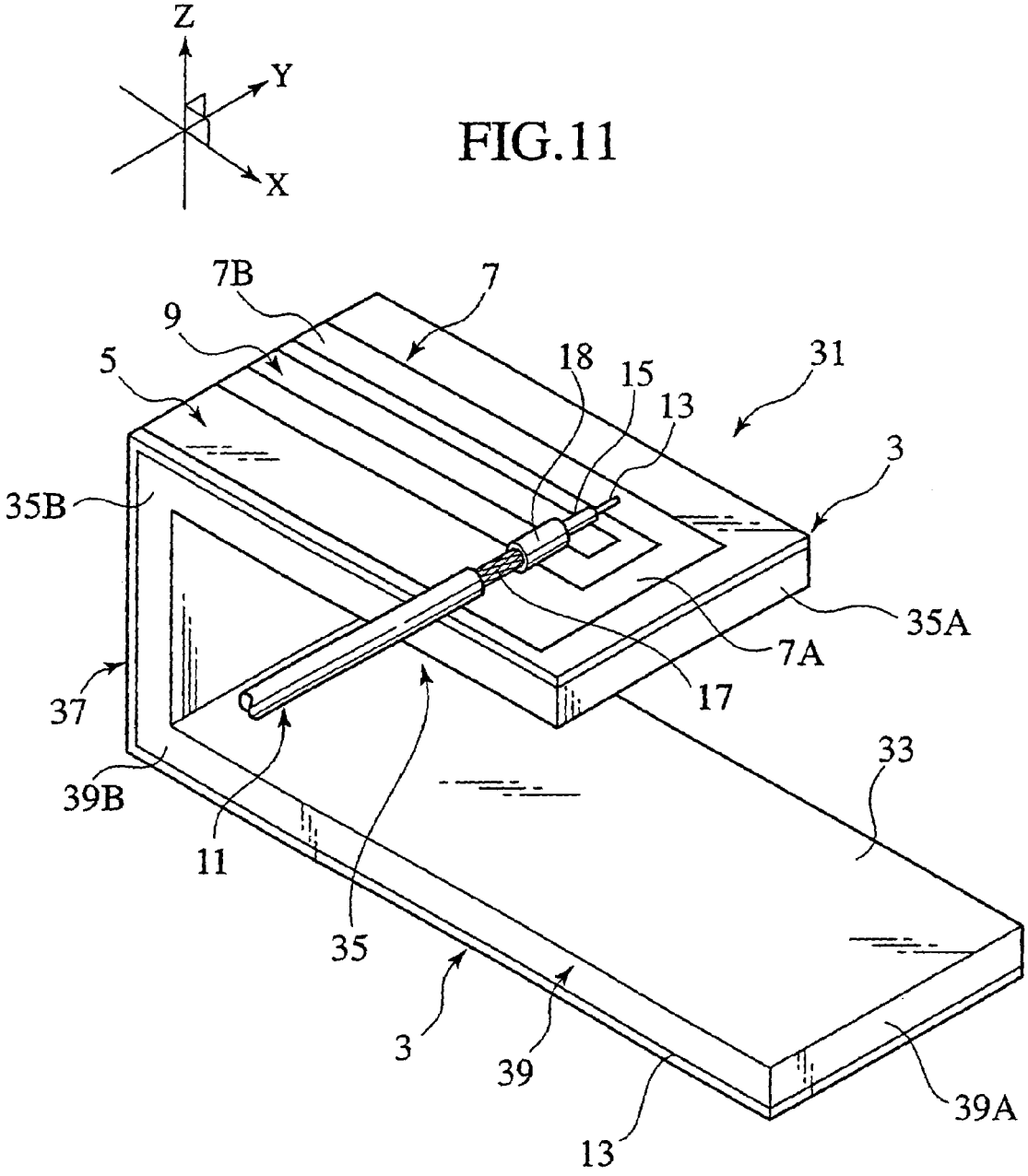
FIG. 11 is a perspective view of the two-resonance antenna according to the first embodiment of the present invention applied to a support member.

FIG. 11 is a perspective view of the two-resonance antenna device 31. Also, in the present embodiment, a longitudinal direction, a lateral direction and a vertical direction of the support member 33 are assigned to an X-axis, a Y-axis and a Z-axis, respectively, and the X-axis, the Y-axis and the Z-axis perpendicularly cross one another. The two-resonance antenna device 31 comprises the two-resonance antenna 1 and the support member 33. Also, the base member 3, the ground conductor 5, the first antenna element 7 and the second antenna 9 have flexibilities.

The support member 33 has rigidity and is made of non-conductive material (insulation material) such as resin or ceramic. The support member 33 is integrally formed of an upper end portion 35, an interconnecting portion 37 and a lower end portion 39. Longitudinal axes of the upper end portion 35 and the lower end portion 39 extend along the X-axis, and lateral axes of these components extend along the Y-axis. A distal end 35A of the upper end portion 35 is located on a −X side with respect to a distal end 39A of the lower end portion 39. A longitudinal axis of the interconnecting portion 37 extends along the Z-axis, and a lateral axis of this component extends along the Y-axis. One end of the interconnecting portion 37 is connected to a base end portion 35B of the upper end portion 35, and the other end of the interconnecting portion 37 is connected to a base end portion 39B of the lower end portion 39.

A length of the base member 3 is set to equal a total length of the upper end portion 35, the interconnecting portion 37 and the lower end portion 39 of the support member 33. The base member 3 and the support member 33 are fixed to each other by means of a two-sided tape or adhesive. In a state of fixing the base member 3 to the support member 33, the base member 3 is disposed on an outside surface of the support member 33. The ground conductor 5, the first antenna element 7 and the second antenna element 9 are foldable depending on a folded status of the base member 3. Also, the base member 3 may be provided with rigidity and used as a support in place of the support member 33.

The two-resonance antenna device 31 has advantageous features listed below.

Even if displacement occurs in a relative position between the support member 33 and the base member 3 at a time of applying the base member 3 on the support member 33, no changes occurs in the shape of the ground conductor 5, the shape of the first antenna element 7, the shape of the second antenna element 9, the relative position between the ground conductor 5 and the second antenna element 9 and the relative position between the first antenna element 7 and the second antenna element 9.

An occupied area of the two-resonance antenna device 31 can be minimized because the base member 3 is formed on the three-dimensional basis.

The two-resonance antenna device 31 is available to be placed in a narrow space and to easily obtain two accurate resonant frequencies. Also, radiation and receipt of three-dimensional waves can be favorably accomplished because the base member 3 is formed on the three-dimensional basis.

The two-resonance antenna device 31 can be easily altered in shape by changing the shape of the support member 33 without altering the shape of the base member 3.

By using an etching technique, the ground conductor 5, the first antenna element 7 and the second antenna element 9 are formed on the base member 3. Therefore, the shapes and the positions of the respective conductive elements can be precisely maintained and each of the conductive elements can be set to have a width less than 1 mm. In addition, each of the conductive elements can be freely formed in a desired shape, and improvement in mass productivity and reduction in manufacturing costs can be realized.

The base member 3, the ground conductor 5, the first antenna element 7 and the second antenna element 9 become hard to deform because the base member 3 is fixed on the support member 33. Therefore, the two-resonance antenna device 31 can be easily handled and maintain the resonant frequencies at given values.

If the base member 3 is fixed on the support member 33 such that the surfaces on which the respective conductive elements are placed is held in contact with the support member 33, the respective conductive elements become hard to be damaged because they do not appear on the surface of the two-resonance antenna device 31.

A mass of the two-resonance antenna device 31 is reduced because the support member 33 is formed of resin or ceramics. Also, the two-resonance antenna device 31 can easily secure compatibility with the inverted-F antenna of the related art because the two-resonance antenna 31 is formed in the same shape as that of an inverted-F antenna of the related art.

Since the base member 3 is applied onto the surface of the support member 33, application work of the base member 3 can be easily performed and manufacturing work of the two-resonance antenna device 31 can be easily accomplished.

If the sheath 18 of the coaxial cable 11 is used to prevent the second antenna element 9 from directly contact to the center conductor 13 or the outer conductor 15 of the coaxial cable 11, the two-resonance antenna device 31 can be constructed without separately preparing other members having insulating properties.

Further, the support member 33 and the base member 3 may be suitably altered in shape. Also, the ground conductor 5, the first antenna element 7 and the second antenna element 9 which are formed on the base member 3 may be suitably altered in shapes. For example, the two-resonance antenna device 31 may be formed by forming the support member 33 in a spherical shape and then adhering the support member 33 on the base member which is formed in a shape conforming to that of the support member. Moreover, in order to obtain more than three accurate resonant frequencies, the base member 3 may be separately provided with the other conductor in addition to the ground conductor 5, the first antenna element 7 and the second antenna element 9.

Figure 12A:
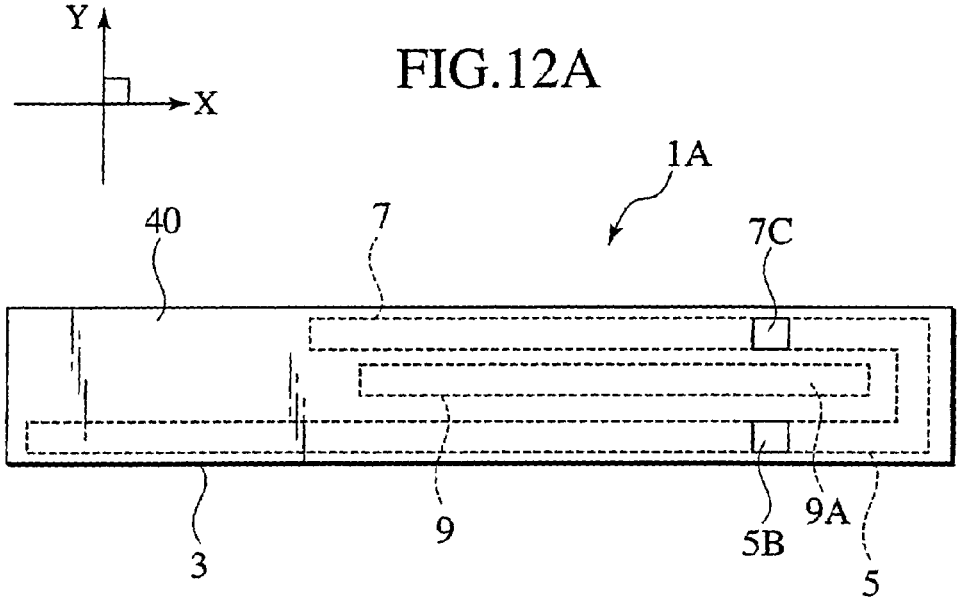
FIG. 12A is a view illustrating a first modified form of the two-resonance antenna according to the first embodiment of the present invention.

FIG. 12A is a view illustrating a first modified form of the two-resonance antenna 1 of the present embodiment. A two-resonance antenna 1A comprises the base member 3, the ground conductor 5, the first antenna element 7, the second antenna element 9 and an insulation layer 40. A difference between the two-resonance antenna 1 and the two-resonance antenna 1A resides in structure in which a portion of a surface of the two-resonance antenna 1A is covered with the thin insulation layer 40, and both antennas are the same in other structure. More particularly, the insulation layer 40 is covered over the base member 3, the first antenna element 7 except for the first connecting portion 7C, the second antenna element 9, and the ground conductor 5 except for the second connecting portion 5B. Also, the insulation layer 40 may be suffice to be covered over at least the first antenna element 7 except for the first connecting portion 7C, the second antenna element 9 and the ground conductor 5 except for the second connecting portion 5B.

Figure 12B:
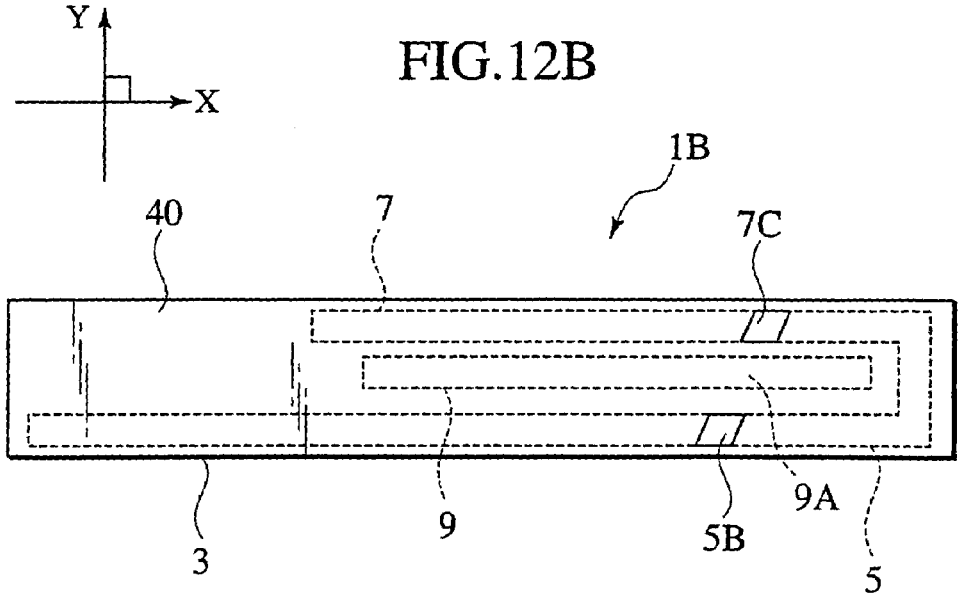
FIG. 12B is a view illustrating a second modified form of the two-resonance antenna according to the first embodiment of the present invention.

FIG. 12B is a view illustrating a second modified form of the two-resonance antenna 1 of the present embodiment. A difference between the two-resonance antenna 1B and the two-resonance antenna 1A resides in structure in which the first connecting portion 7C and the second connecting portion 5B are not located along the Y-axis, and both antennas are the same in other structure. Also, the first connecting portion 7C and the second connecting portion 5B are arranged in such a structure as a result of impedance adjustment made between the two-resonance antenna 1B and the coaxial cable 11.

The two-resonance antennas 1A, 1B have advantageous features listed below.

Due to provision of the insulation layer 40, the ground conductor 5, the first antenna element 7 and the second antenna element 9 become hard to be damaged.

Painting the insulation layer 40 one color and the base member 3 another color allows the positions of the first connecting portion 7C and the second connecting portion 5B to be easily discriminated from each other.

Upon provision of the insulation layer 40, since the two-resonance antennas 1A, 1B can directly contact with the other members, no need arises where a separate insulation member is provided in a case where the two-resonance antennas 1A, 1B are mounted in a radio communication apparatus.

Figure 12C:
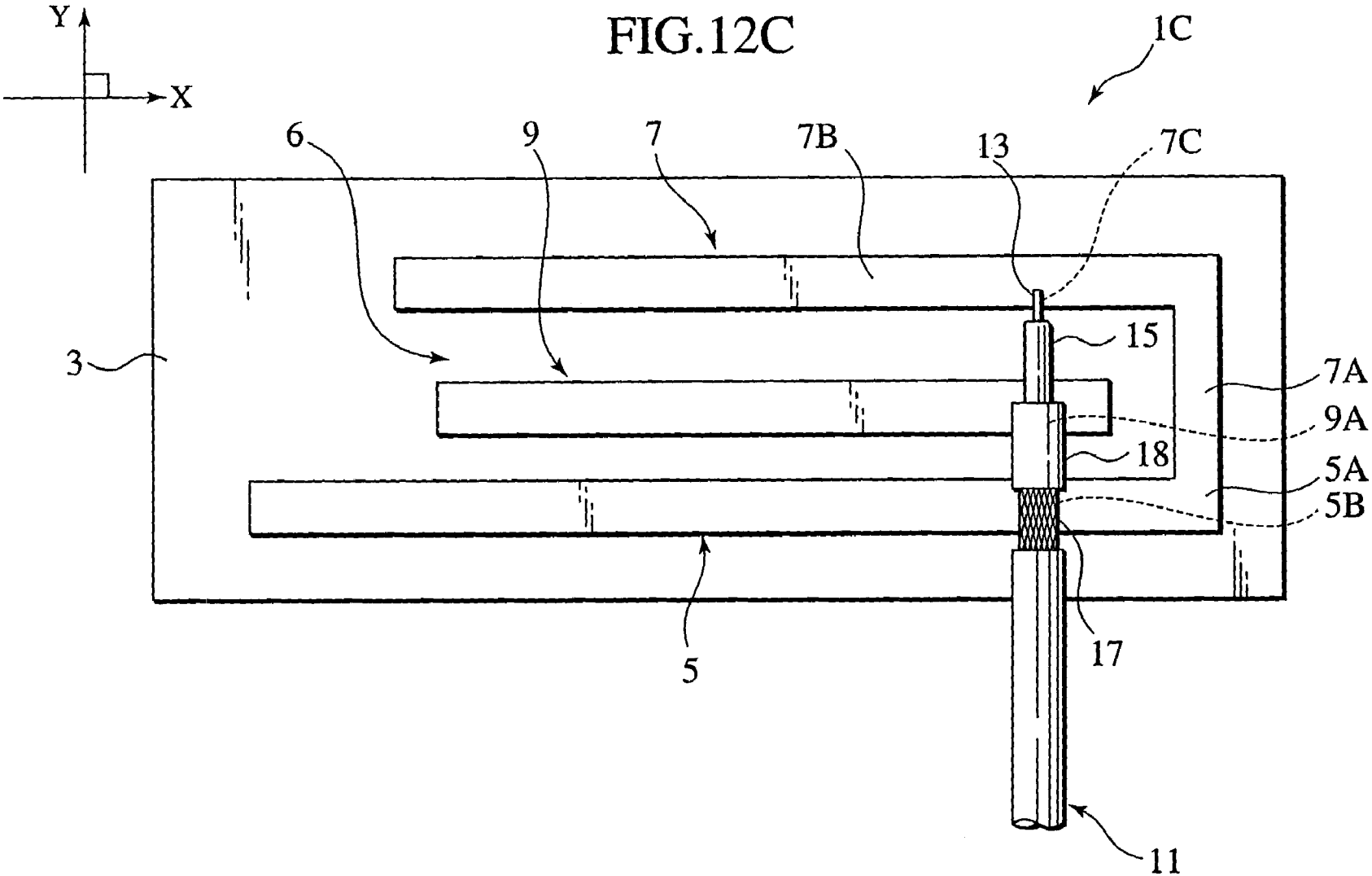
FIG. 12C is a view illustrating a third modified form of the two-resonance antenna according to the first embodiment of the present invention.

FIG. 12C is a view illustrating a third modified form of the two-resonance antenna 1 of the present embodiment. A difference between the two-resonance antenna 1C and the two-resonance antenna 1 resides in structure in which the ground conductor 5 has the same width as the first antenna element 7 and is located so as to extend along the X-axis from one end to the other end of the base member 3, and both antennas are entirely the same in other structure.

The two-resonance antenna according to the present invention can be suitably altered without being limited by the various embodiments described above.

There is no need for the ground conductor 5, the first antenna element 7 and the second antenna element 9 to be disposed on one surface of the base member 3, and second antenna element 9 may be located on a rear surface of the base member 3.

The ground conductor 5 and the first antenna element 7 may be connected to each other so as not to form the slit portion 6 and, further, the second antenna element 9 may not be disposed in the slit portion 6. That is, the second antenna element 9 may be disposed on the base member 3 so as not to directly connect to the ground conductor 5 and the first antenna element 7 after the base member 3 is formed with the ground conductor 5 with a large surface area and then one end of the first antenna element 7 is connected to one end of the ground conductor 5.

In place of the coaxial cable 11, a cable in which two lead wires extend in parallel to each other may be employed.

It may be designed such that a plurality of antenna elements are additionally disposed on the surface of the base member 3 such that these additional antenna elements do not directly connect to the ground conductor 5, the first antenna element 7 and the second antenna element 9, whereby the additional antenna elements resonate at more than two frequencies.

SECOND EMBODIMENT

Figure 13:
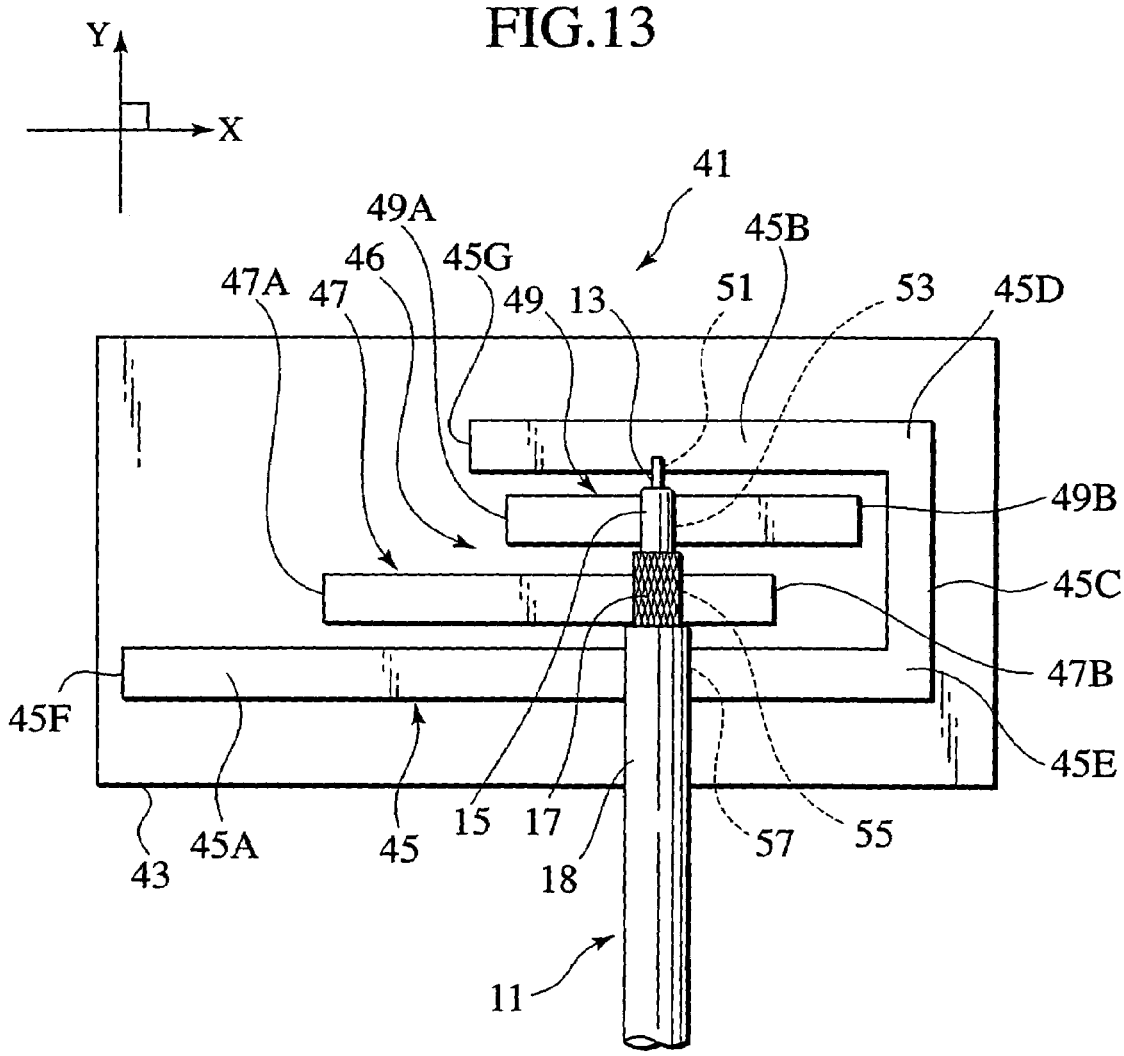
FIG. 13 is a plan view of a two-resonance antenna according to a second embodiment of the present invention.

FIG. 13 is a plan view of a two-resonance antenna 41. In the present embodiment, a major axis and a minor axis of a base member 43 are assigned to an X-axis and a Y-axis, respectively, and the X-axis and the Y-axis perpendicularly cross each other.

The two-resonance antenna 41 is a monopole antenna formed in a film shape and comprises the base member 43, a first antenna element 45, a second antenna element 47 and an impedance adjustment element 49. The base member 43 is formed of a rectangular thin plate with flexibility and is made of dielectric material such as resin of polyamide system. The first antenna element 45, the second antenna element 47 and the impedance adjustment element 49 are formed on a surface of the base member 43.

The first antenna element 45 is a conductor formed in a strip shape with a first radiating portion 45A, a second radiating portion 45B and an interconnecting portion 45C. The first radiating portion 45A is disposed along the X-axis. The second radiating portion 45B is disposed on a +Y side with respect to the first radiating portion 45A and along the X-axis. A distal end 45G of the second radiating portion 45B terminates on a +X side with respect to a distal end 45F of the first radiating portion 45A. The interconnecting portion 45C is disposed along the Y-axis and provides electrical connection between a base end 45E of the first radiating portion 45A and a base end portion 45D of the second radiating portion 45B. With such an arrangement, a slit portion 46 having an open at one end thereof is formed on the base member 43.

The second antenna element 47 is formed in a strip shape. The second antenna element 47 is disposed in the slit portion 46 along the X-axis. A distal end 47A of the second antenna element 47 terminates on a +X side with respect to the distal end 45F of the first radiating portion 45A and on a −X side with respect to the distal end 45G of the second radiating portion 45B.

The impedance adjustment element 49 is formed in a strip shape. The impedance adjustment element 49 is disposed in the slit portion 46 along the X-axis and between the second radiating portion 45B of the first antenna element 45 and the second antenna element 47. A distal end 49A of the impedance adjustment element 49 terminates on a +X side with respect to the distal end 45G of the second radiating portion 45B of the first antenna element 45 and on a +X side with respect to the distal end 47A of the second antenna element 47. A base end portion 49B of the impedance adjustment element 49 terminates on +X side with respect to a base end portion 47B of the second antenna element 47. Also, the impedance adjustment element 49 may be located on a rear surface of the base member 43.

The antenna elements used by the two-resonance antenna 41 decrease in length in the order corresponding to the first radiating portion 45A of the first antenna element 45, the second antenna element 47, the second radiating portion 45B of the first antenna element 45 and the impedance adjustment element 49. Here, it is noted that lengths of the second radiating portion 45B of the fist antenna element 45 and the impedance adjustment element 49 can be varied so as to adjust a resonance frequency of the two-resonance antenna 41.

Figure 14:
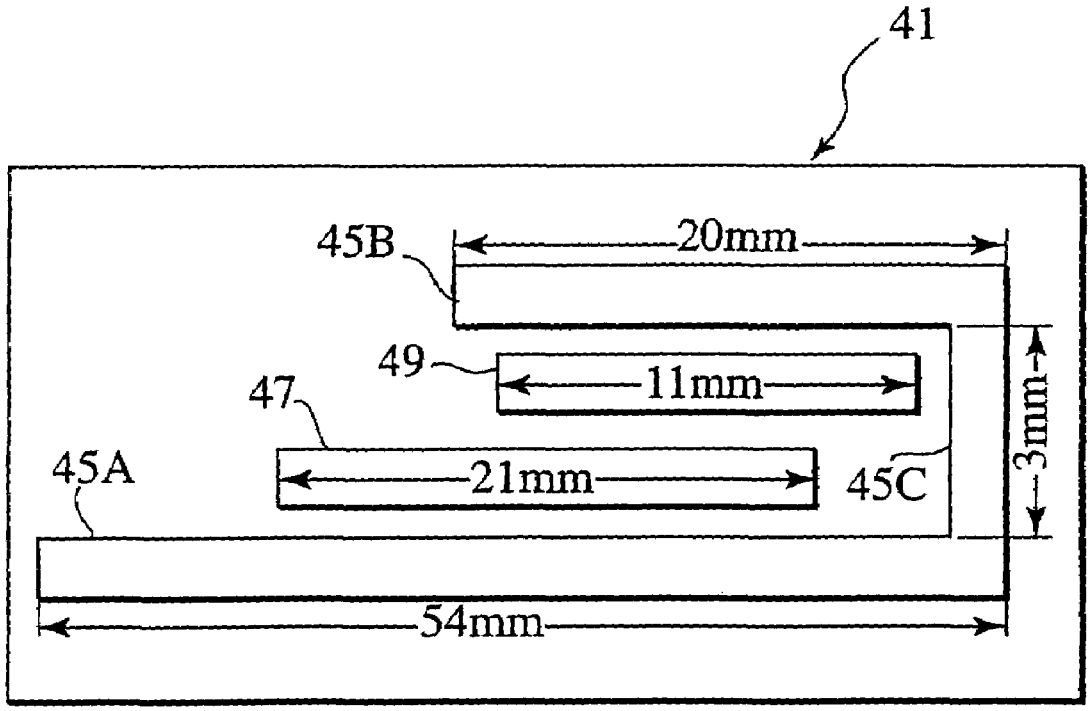
FIG. 14 is a view illustrating actual sized of antenna elements used in the two-resonance antenna according to the second embodiment of the present invention.

As shown in FIG. 14, actual sizes of the antenna elements used in the present invention are as follows. The first radiating portion 45A of the first antenna element 45 is a conductor having 1 mm in width and 54 mm in length. The second radiating portion 45B of the first antenna element 45 is a conductor having 1 mm in width and 20 mm in length. The interconnecting portion 45C of the first antenna element 45 is a conductor having 1 mm in width and 3 mm in length. The second antenna element 47 is a conductor having 1 mm in width and 21 mm in length and is disposed in the slit portion 46 at about 7 mm distance from the interconnecting portion 45C of the first antenna element 45. The impedance adjustment element 49 is a conductor having 1 mm in width and 11 mm in length and is disposed at about 7 mm distance from the interconnecting portion 45C of the first antenna element 45. Here, it is noted that the impedance adjustment element 49 may be displaced in the direction of the X-axis with respect to the second antenna element 47 within the range of about 3 mm.

The coaxial cable 11 has the same structure as that of the coaxial cable employed in the first embodiment. Also, in place of the coaxial cable 11, a cable in which two lead wires extend in parallel to each other may be employed.

As shown in FIG. 13, a first connecting portion 51 is formed on a part of the second radiating portion 45B of the first antenna element 45 in order to electrically connect the first antenna element 45 to the center conductor 13 of the coaxial cable 11 by direct-current electricity. A first contact portion 53 is formed on a part of the impedance adjustment element 49 in order to fix the impedance adjustment element 49 to the covering material 15 of the coaxial cable 11 by contact or an adhesive. The impedance adjustment element 49 is isolated from the center conductor 13 and the outer conductor 17 of the coaxial cable 11 by the covering material 15 of the coaxial cable 11. A second connecting portion 55 is formed on a part of the second antenna element 47 in order to electrically connect the second antenna element 47 to the outer conductor 17 of the coaxial cable 11 by direct-current electricity. A second contact portion 57 is formed on a part of the first radiating portion 45A of the first antenna element 45 in order to fix the first antenna element 45 to the sheath 18 of the coaxial cable 11 by contact or an adhesive. The first radiating portion 45A is isolated from the center conductor 13 and the outer conductor 17 of the coaxial cable 11 by the sheath 18 of the coaxial cable 11. The first connecting portion 51, the second connecting portion 55, the first contact portion 53 and the second contact portion 57 are located on a straight line along the Y-axis.

The center conductor 13 exposed at a terminal portion of the coaxial cable 11 is connected to the first connecting portion 51 by soldering. The center conductor 13 covered with the covering material 15 is fixed to the first contact portion 53 by contact or an adhesive. Since the center conductor 13 is not directly connected to the impedance adjustment element 49, no electric current flows between the impedance adjustment element 49 and the center conductor 13 even when applied with direct-current electricity. The outer conductor 17 exposed from the coaxial cable 11 is connected to the second connecting portion 55 by soldering. The outer conductor 17 covered with the sheath 18 is fixed to the second contact portion 57 by contact or an adhesive. Since the outer conductor 17 is not directly connected to the first radiating portion 45A of the first antenna 45, no electric current flows between the first radiating portion 45A and the outer conductor 17 even when applied with direct-current electricity.

The first antenna element 45 is capacitively coupled with the second antenna element 47 and the impedance adjustment element 49 via the base member 43. This arrangement is equivalent to an arrangement in which the first antenna element 45 is connected to the second antenna element 47 and the impedance adjustment element 49 via a capacitor. Accordingly, if alternating-current electricity is applied to the center conductor 13 of the coaxial cable 11, electric current flows between the first antenna element 45 and the second antenna element 47 and between the first antenna element 45 and the impedance adjustment element 49.

First resonance of the two-resonance antenna 41 is generated by electric current distributed on the first antenna element 45. Second resonance of the two-resonance antenna 41 is generated by electric current distributed on the second antenna element 47. Since the impedance adjustment element 49 serves to adjust impedance between the two-resonance antenna 41 and the coaxial cable 11 so as to decrease a value of the VSWR, a plurality of band widths with a frequency in which the VSWR has a value less than "2" are secured.

Figure 15:
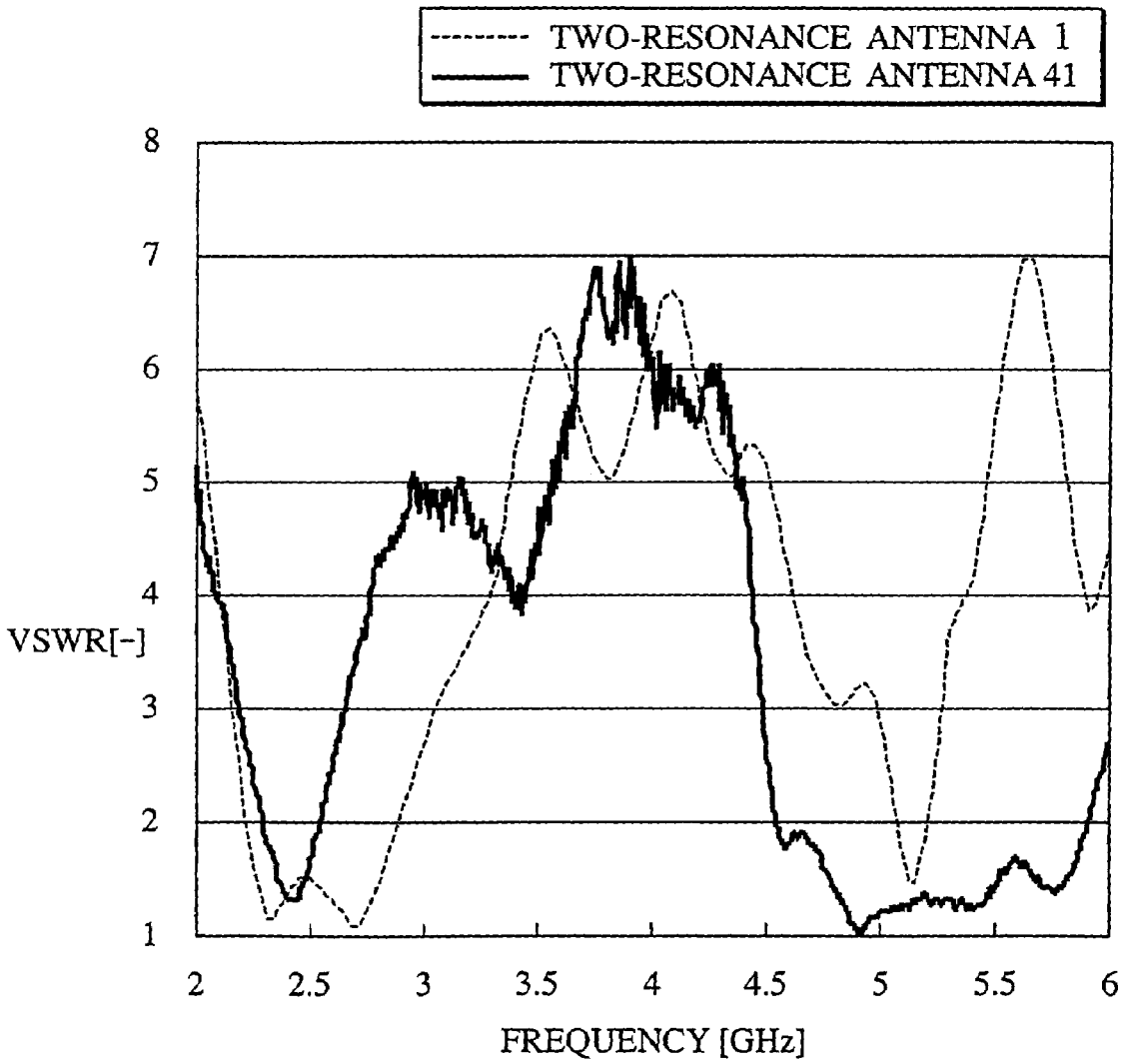
FIG. 15 is a view illustrating a VSWR characteristic of the two-resonance antenna according to the second embodiment of the present invention.
Figure 16B:
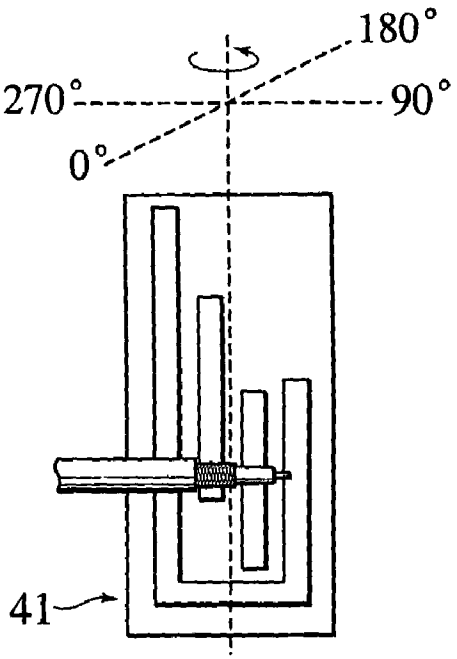
FIG. 16B is a view illustrating a rotative direction of the two-resonance antenna according to the second embodiment in FIG. 16A.
Figure 16A:
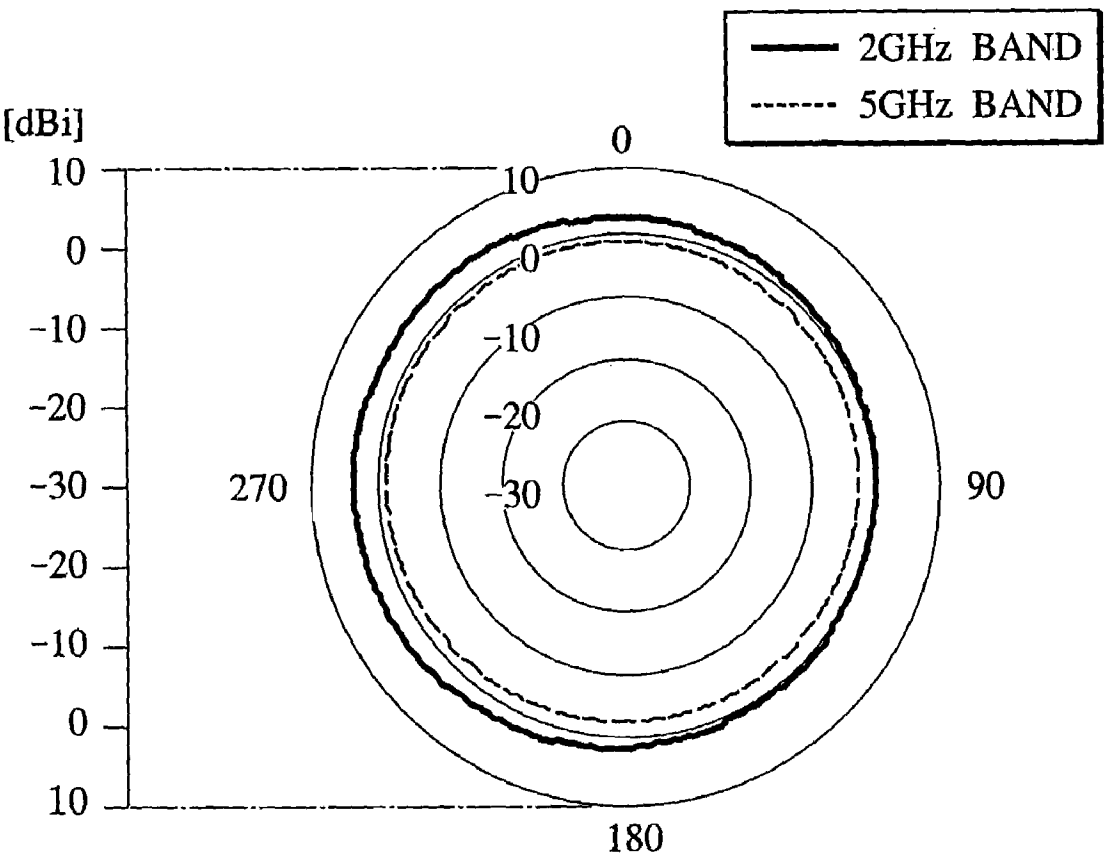
FIG. 16A is a view illustrating a radiating characteristic of the two-resonance antenna according to the second embodiment of the present invention.

The two-resonance antenna 41 thus constructed has a VSWR characteristic shown in FIG. 15 and a radiating characteristic shown in FIG. 16A.

A graph indicated by a broken line in FIG. 15 represents the VSWR characteristic of the two-resonance antenna 1. A graph indicated by a solid line in FIG. 15 represents the VSWR characteristic of the two-resonance antenna 41. In FIG. 15, there are two band widths appearing at two regions with a frequency in which the VSWR has a value less than "2". One of these regions lies in a value ranging from 2.3 GHz to 2.6 GHz. The other of these regions lies in a value ranging from 4.5 GHz to 5.9 GHz. Accordingly, the band widths correspond to a range of approximately 300 MHz at 2 GHz band and a range of approximately 1400 MHz at 5 GHz band.

With the two-resonance antenna 1, the VSWR value exhibits the minimal value at a frequency of approximately 5.15 GHz, and a frequency range (frequency band) in which the VSWR value is less than "2" lies between 5.1 GHz and 5.2 GHz. With the two-resonance antenna 41, the VSWR value exhibits the minimal values at frequencies of approximately 4.9 GHz and 5.8 GHz, and a frequency range in which the VSWR value is less than "2" lies between 4.5 GHz and 5.9 GHz, resulting in an increase in the frequency range in which the VSWR value is less than "2". Here, it is noted that the increase in the frequency range set forth above is based on one factor in which the above-described minimal values are close to each other. The two-resonance antenna 41 generates the resonant frequency in the vicinity of 2 GHz substantially similar to that of the two-resonance antenna 1.

As shown in FIG. 16A, in 2 GHz and 5 GHz bands, the radiating characteristic of the two-resonance antenna 41 has vertical polarized waves forming main polarized waves with shapes nearly equal to circular configurations and has high-gain availabilities. Accordingly, the two-resonance antenna 41 has omnidirection and high-gain availability that are desired characteristics of the antenna.

The two-resonance antenna 41 has advantageous features listed below.

The first resonant frequency and the second resonant frequency can be freely set to arbitrary values, respectively, because the first antenna element 45 on which the first resonant frequency is generated and the second antenna element 47 on which the second resonant frequency is generated are disposed to be independent from each other.

Impedance adjustment between the two-resonance antenna 41 and the coaxial cable 11 can be easily performed because the impedance adjustment element 49 can be disposed to be independent from the first antenna element 45 and the second antenna element 47.

Impedance adjustment between the two-resonance antenna 41 and the coaxial cable 11 can be easily performed because the first connecting portion 51, the second connecting portion 55, the first contact portion 53 and the second contact portion 57 can be set to respective positions independent from one another.

The coaxial cable 11 can be easily fixed to the two-resonance antenna 41 because the first connecting portion 51, the second connecting portion 55, the first contact portion 53 and the second contact portion 57 are disposed on the surface of the base member 43. In addition, the coaxial cable 11 can be easily fixed to the two-resonance antenna 41 without bending because the first connecting portion 51, the second connecting portion 55, the first contact portion 53 and the second contact portion 57 are linearly located.

The antenna can be realized in a miniaturized and thin structure because the two-resonance antenna 41 is fabricated by forming the split portion 46 which opens at one end thereof on the base member 43 and locating the rectangular second antenna element 47 and the rectangular impedance adjustment element 49 in the slit portion 46 dependent on the shape of the first antenna element 45.

Electrical capacitances between the second antenna element 47 and the first radiating portion 45A and between the second antenna element 47 and the second radiating portion 45B can be easily ensured such that they have respective large values because the second antenna element 47 is formed in an elongated state in substantially parallel to and along the first radiating portion 45A and the second radiating portion 45B of the first antenna element 45 and is disposed between the first radiating portion 45A and the second radiating portion 45B of the first antenna element 45.

Noises occurring in the two-resonance antenna 41 are absorbed by the outer conductor 17 because the coaxial cable 11 in which the outer conductor 17 is disposed outside the center conductor 13 is employed as the electric power supply line for the antenna.

A simplification in an antenna structure and reduction in manufacturing cost can be realized because the two-resonance antenna 41 is manufactured by forming the first antenna element 45, the second antenna element 47 and the impedance adjustment element 49 in thin film metallic elements on the surface of the base member 3 made of the dielectric material of the polyamide system.

A plurality of resonant frequencies can be easily generated at 5 GHz band by means of the two-resonance antenna 41 because the two-resonance antenna 41 has a wide band width at 5 GHz band. In addition, the two-resonance antenna 41 can generate a resonant frequency at 2 GHz band as in the case of the two-resonance antenna 1.

Figure 17:
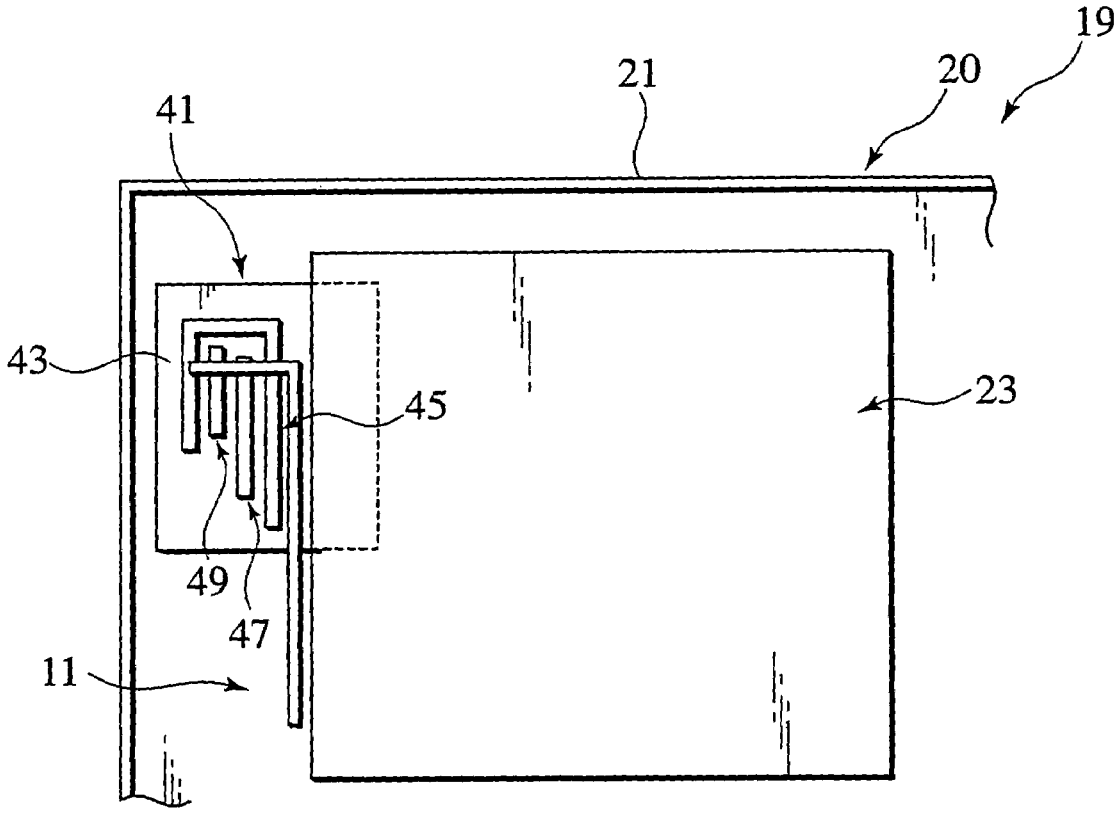
FIG. 17 is a schematic illustrative view of the two-resonance antenna according to the second embodiment of the present invention mounted on an LCD section of a notebook-sized PC.
Figure 18:
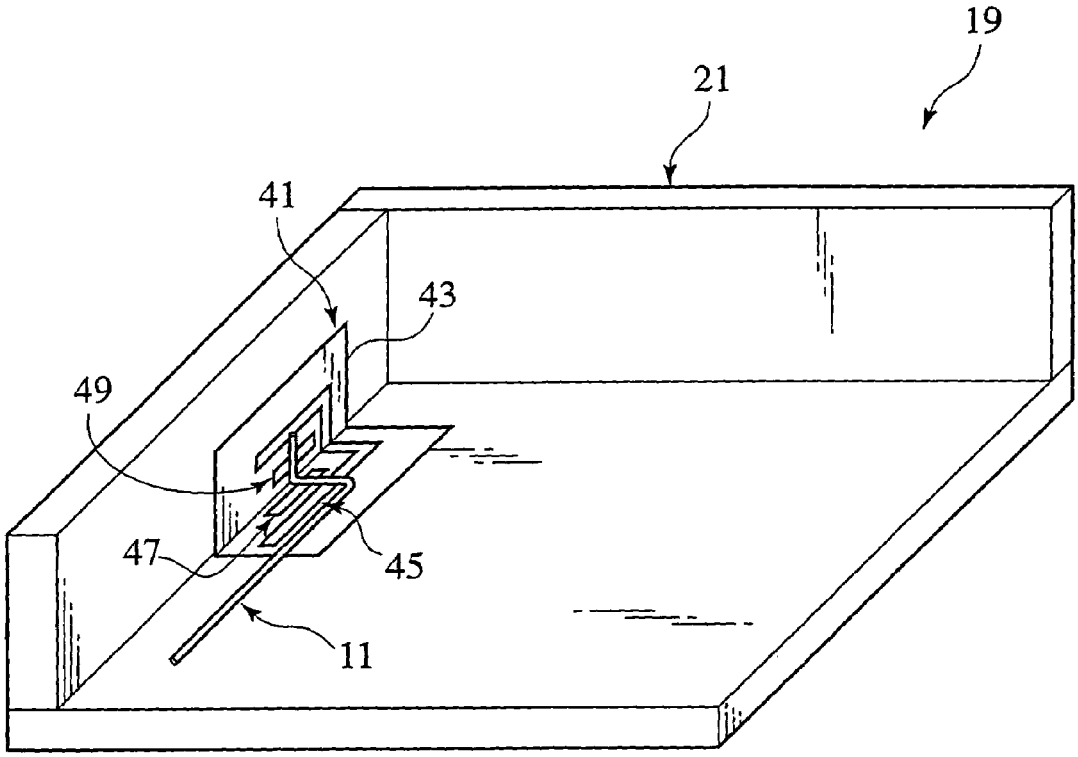
FIG. 18 is a perspective view of the two-resonance antenna according to the second embodiment of the present invention mounted on a corner area of a case of the notebook-sized PC.
Figure 19:
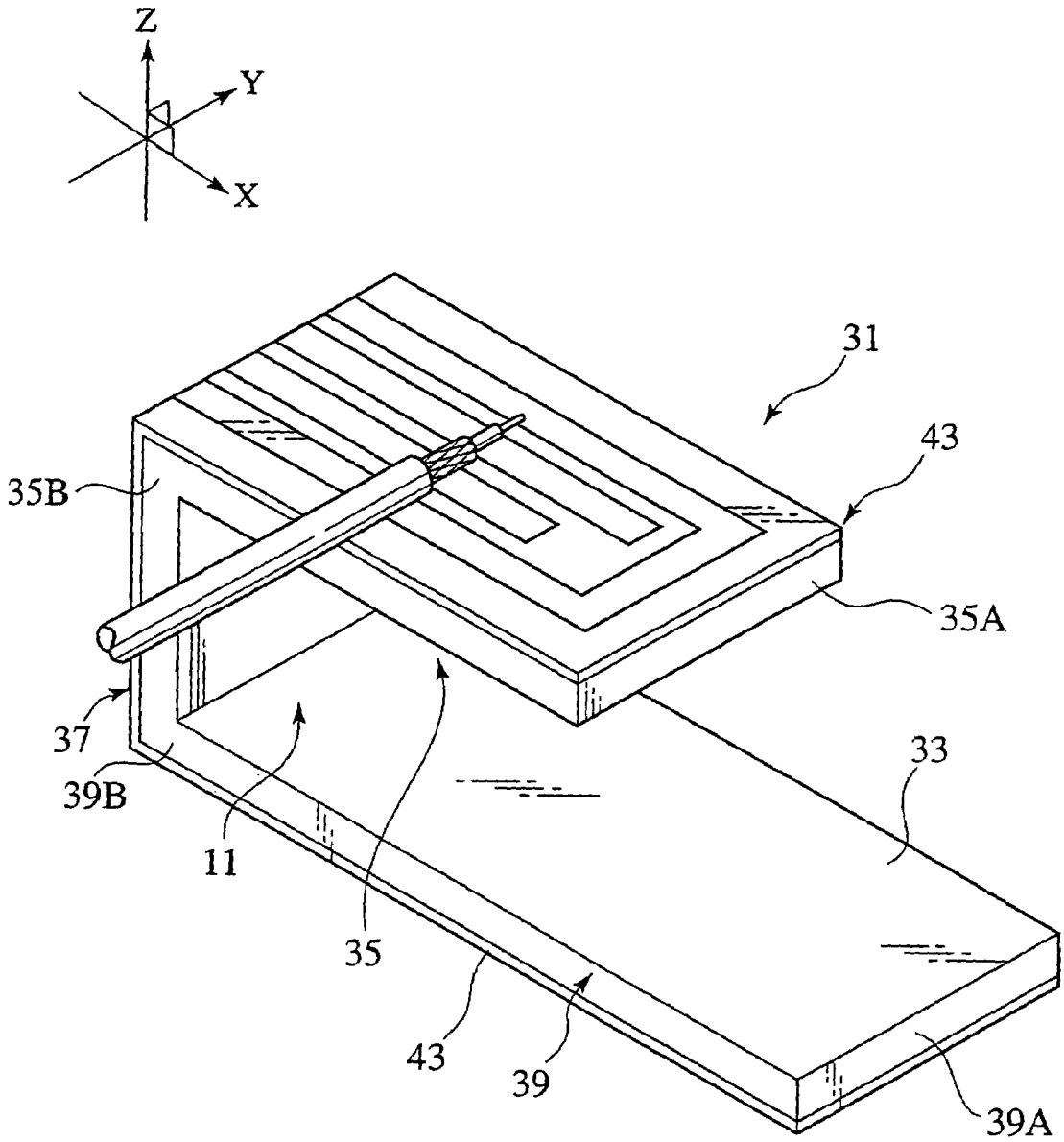
FIG. 19 is a perspective view of the two-resonance antenna according to the second embodiment of the present invention applied to a support member.

When the two-resonance antenna 41 is applied to a notebook-sized PC as an antenna for a wireless LAN compatible with two-frequencies, the two-resonance antenna 41 can be installed on an LCD section and a corner portion of a casing of the notebook-sized PC, and a support member (see FIGS. 17, 18, 19).

Figure 20:
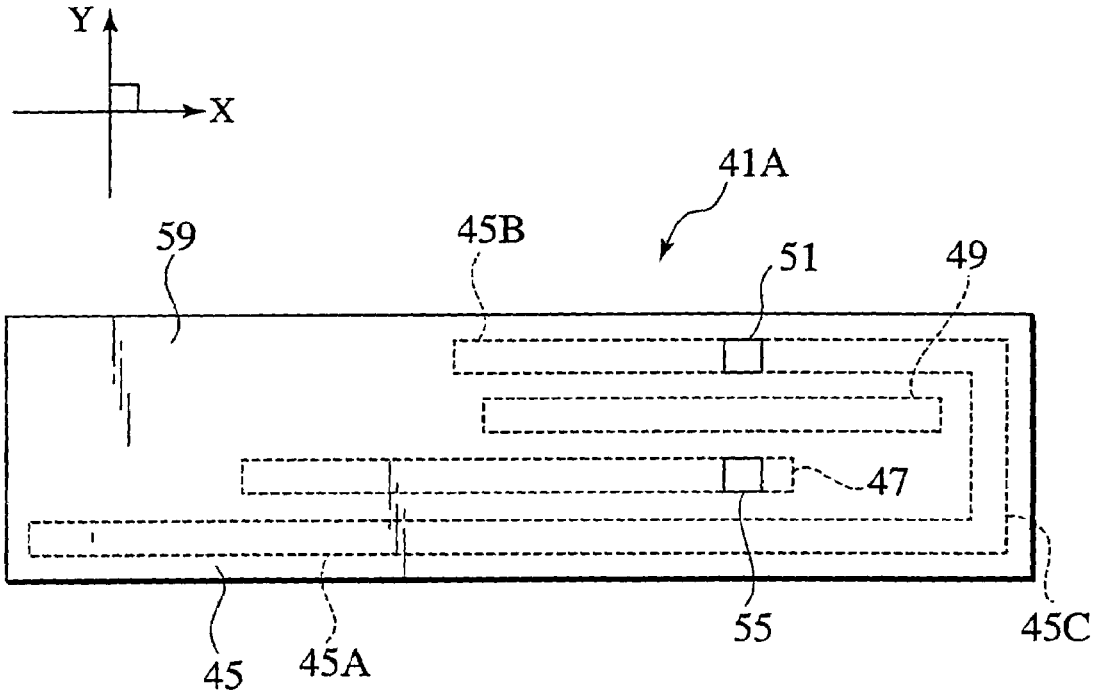
FIG. 20 is a modified form of the two-resonance antenna according to the second embodiment of the present invention.

A thin insulation layer 59 may be covered on a portion of the surface of the two-resonance antenna 41 as a two-resonance antenna 41A (see FIG. 20). More specifically, the insulation layer 59 covers the base member 43, the first antenna element 45 except for the first connecting portion 51, the second antenna element 47 except for the second connecting portion 55 and the impedance adjustment element 49.

THIRD EMBODIMENT

Figure 21:
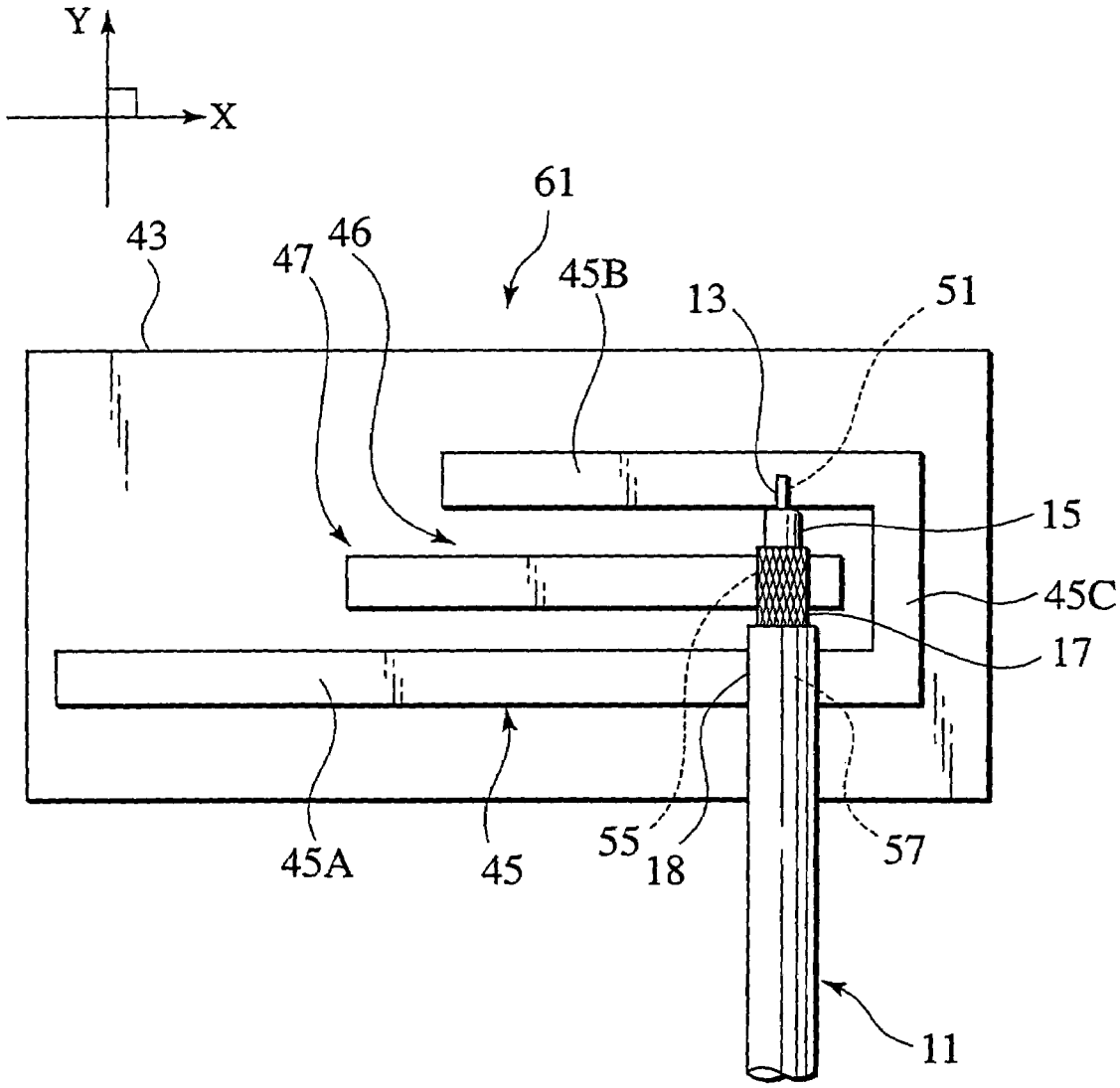
FIG. 21 is a plan view of a two-resonance antenna of a third embodiment according to the present invention.

FIG. 21 is a plan view of a two-resonance antenna 61. In the present embodiment, a major axis and a minor axis of a base member 63 are assigned to an X-axis and a Y-axis, respectively, and the X-axis and the Y-axis perpendicularly cross each other.

The two-resonance antenna 61 and the two-resonance antenna 41 of the second embodiment are different in structure in which the impedance adjustment element 49 is removed from the slit portion 46 and are entirely identical in other structure.

The coaxial cable 11 has the same structure as that of the coaxial cable employed in the first embodiment. Also, in place of the coaxial cable 11, a cable in which two lead wires extend in parallel to each other may be employed.

First resonance of the two-resonance antenna 61 is generated by electric current distributed on the first antenna element 45. Second resonance of the two-resonance antenna 61 is generated by electric current distributed on the second antenna element 47.

Figure 22:
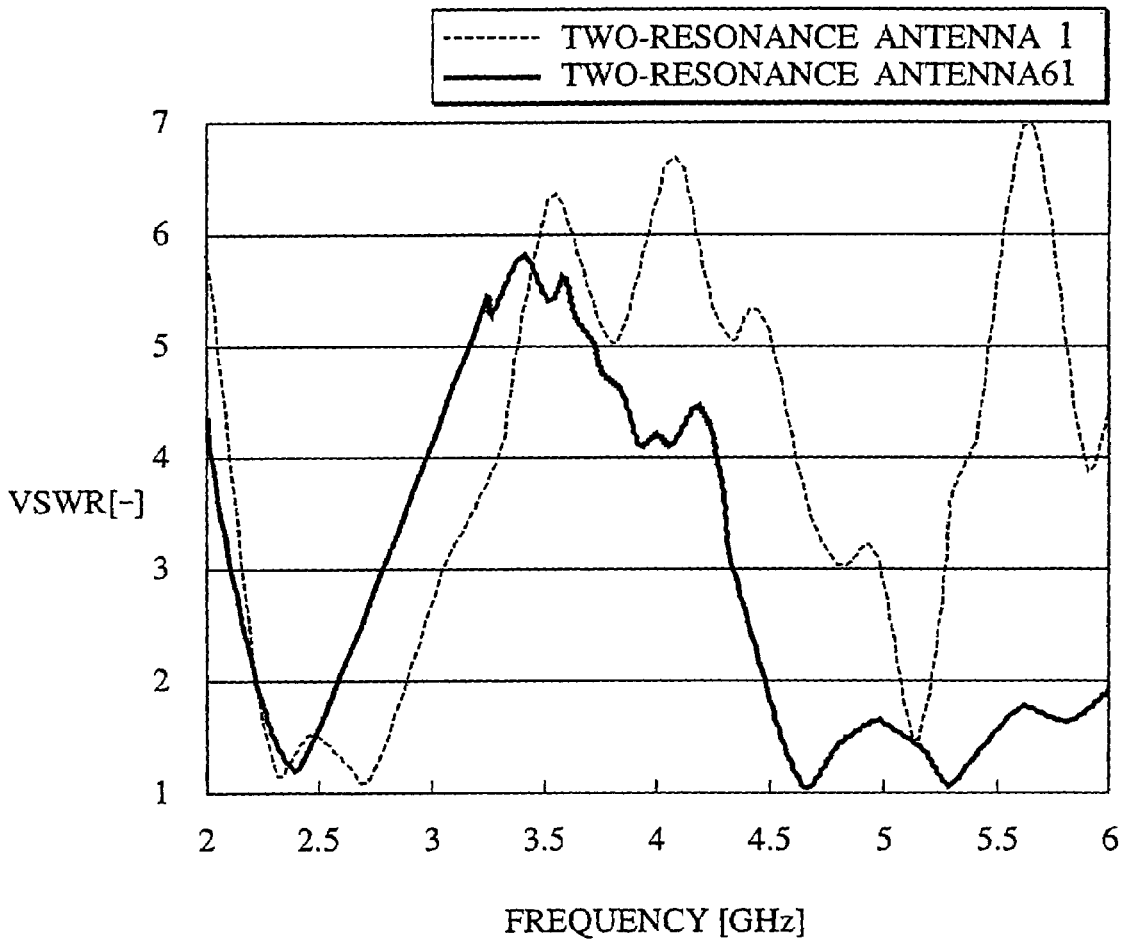
FIG. 22 is a view illustrating a VSWR characteristic of the two-resonance antenna according to the third embodiment of the present invention.
Figure 23B:
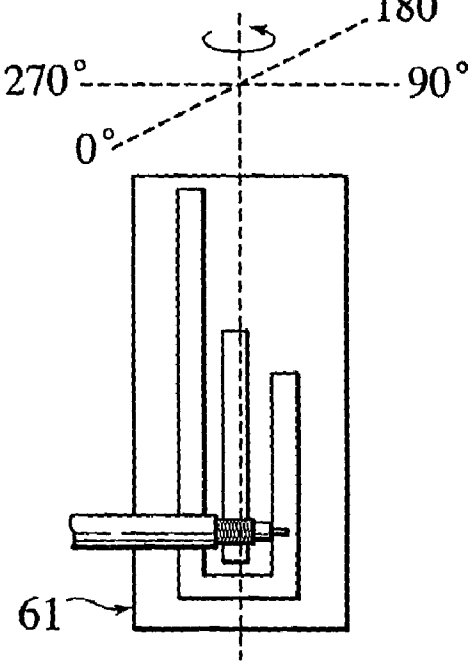
FIG. 23B is a view illustrating a rotative direction of the two-resonance antenna according to the third embodiment in FIG. 19A.
Figure 23A:
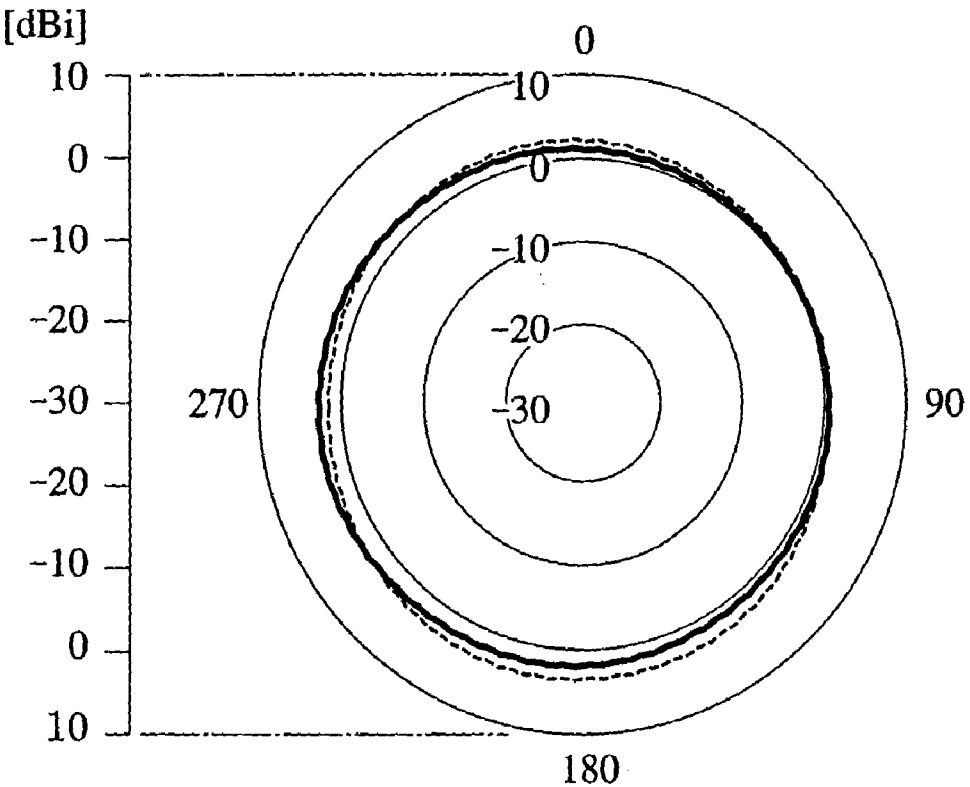
FIG. 23A is a view illustrating a radiating characteristic of the two-resonance antenna according to the third embodiment of the present invention.

The two-resonance antenna 61 thus constructed has a VSWR characteristic shown in FIG. 22 and a radiating characteristic shown in FIG. 23A.

A graph indicated by a broken line in FIG. 22 represents the VSWR characteristic of the two-resonance antenna 1. A graph indicated by a solid line in FIG. 22 represents the VSWR characteristic of the two-resonance antenna 61. In FIG. 22, there are two band widths appearing at two regions with a frequency in which the VSWR has a value less than "2". One of these regions lies in a value ranging from 2.2 GHz to 2.6 GHz. The other of these regions lies in a value ranging from 4.5 GHz to 6.0 GHz. Accordingly, the band widths correspond to a range of approximately 400 MHz at 2 GHz band and a range of approximately 1500 MHz at 5 GHz band.

With the two-resonance antenna 1, the VSWR value exhibits the minimal value at a frequency of approximately 5.15 GHz, and a frequency range (frequency band) in which the VSWR value is less than "2" lies between 5.1 GHz and 5.2 GHz. With the two-resonance antenna 61, the VSWR value exhibits the minimal values at frequencies of approximately 4.7 GHz and 5.3 GHz, and a frequency range in which the VSWR value is less than "2" lies between 4.5 GHz and 6.0 GHz, resulting in an increase in the frequency range in which the VSWR value is less than "2". Here, it is noted that the increase in the frequency range set forth above is based on one factor in that the above-described minimal values are close to each other. The two-resonance antenna 61 generates the resonant frequency in the vicinity of 2 GHz substantially similar to that of the two-resonance antenna 1.

As shown in FIG. 23A, in 2 GHz and 5 GHz bands, the radiating characteristic of the two-resonance antenna 61 has vertical polarized waves forming main polarized waves with shapes nearly equal to circular configurations and has high-gain availabilities. Accordingly, the two-resonance antenna 61 has omnidirection and high-gain availability that are desired characteristics of the antenna.

A plurality of resonant frequencies can be easily generated at 5 GHz band by means of the two-resonance antenna 61 because the two-resonance antenna 61 has a wide band width at 5 GHz band. In addition, the two-resonance antenna 61 can generate a resonant frequency at 2 GHz band as in the case of the two-resonance antenna 1.

When the two-resonance antenna 61 is applied to a notebook-sized PC as an antenna for a wireless LAN compatible with two-frequencies, the two-resonance antenna 61 can be installed on an LCD section and a corner portion of a casing of the notebook-sized PC, and a support member like the two-resonance antenna 1 of the first embodiment.

The two-resonance antenna 61 has the substantially same features as those of the two-resonance antenna 1 and, further, a thin insulation layer may be covered on a portion of the surface of the two-resonance antenna 1.

FOURTH EMBODIMENT

Figure 24:
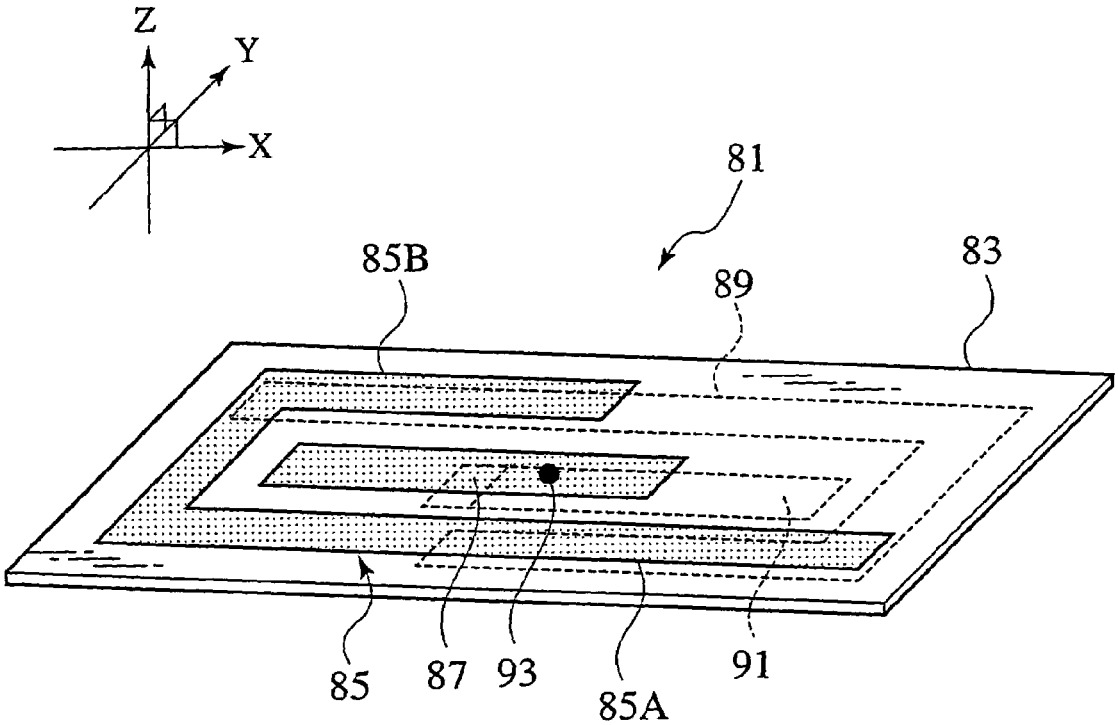
FIG. 24 is a plan view of a two-resonance antenna according to a fourth embodiment of the present invention.

FIG. 24 is a plan view of a two-resonance antenna 81. In the present embodiment, a major axis and a minor axis of a base member 83 are assigned to an X-axis and a Y-axis, respectively, and the X-axis and the Y-axis perpendicularly cross each other.

The two-resonance antenna 81 and the two-resonance antenna 41 of the second embodiment are different in structure in where a first antenna element 89 and a second antenna element 91 are formed on a rear surface of the base member 83 and second antenna elements 87, 91 are electrically connected to each other by means of a through-hole 93, and are entirely identical in other structure.

The through-hole 93 is formed at a central area of the base member 83. Under a condition where a first antenna element 85 is formed on a front surface of the base member 83 and the first antenna element 89 is formed on the rear surface of the base member 83, the first antenna element 85 and the first antenna element 89 are located in a mutually point symmetry with respect to the through-hole 93. Under a condition where the second antenna element 87 is formed on the front surface of the base member 83 and the second antenna element 91 is formed on the rear surface of the base member 83, the second antenna element 87 and the second antenna element 91 are located in a mutually point symmetry with respect to the through-hole 93.

The center conductor of the coaxial cable is electrically connected to a second radiating portion 85B of the first antenna element 85 through a first connecting portion by direct-current electricity. The outer conductor of the coaxial cable is electrically connected to the second antenna element 87 through a second connecting portion by direct-current electricity. The sheath of the coaxial cable is fixed to a first radiating portion 85A of the first antenna element 85 through a contact portion by contact or an adhesive. The first radiating portion 85A is isolated from the center conductor and the outer conductor of the coaxial cable by the sheath of the coaxial cable. The outer conductor of the coaxial cable is electrically connected to the second antenna element 91 through the second connecting portion, the second antenna element 87 and the through-hole 93. Since the coaxial cable is connected to only the front surface of the base member 83, the first antenna element 89 is isolated from the center conductor and the outer conductor of the coaxial cable.

The coaxial cable has the same structure as that of the coaxial cable employed in the first embodiment. Also, in place of the coaxial cable, a cable in which two lead wires extend in parallel to each other may be used.

By adjusting the first antenna elements 85, 89 and the second antenna elements 87, 91 in shape and size so as to allow a mutually positional relationship to remain in a suitable status, the two-resonance antenna 81 generates four resonant frequencies.

For example, if the first antenna element 85 and the second antenna element 87 are disposed on the front surface of the base member 83 and the first antenna element 89 and the second antenna element 91 are disposed on the rear surface of the base member 83 so as to allow two resonant frequencies and the other two resonant frequencies to be generated at 2 GHz band and 5 GHz band, respectively, the resonant frequencies are generated in a wide range at 2 GHz and 5 GHz bands by using only one two-resonance antenna 81.

Here, the first antenna element 85 and the first antenna element 89 do not need to be identical in shape. Similarly, the second antenna element 87 and the second antenna element 91 do not need to be identical in shape.

When the two-resonance antenna 81 is applied to a notebook-sized PC as an antenna for a wireless LAN compatible with two-frequencies, the two-resonance antenna 81 can be installed on an LCD section and a corner portion of a casing of the notebook-sized PC, and a support member like the two-resonance antenna 1 of the first embodiment.

The two-resonance antenna 81 has the substantially same features as those of the two-resonance antenna 1 and, further, a portion of the surface of the two-resonance antenna 81 can be covered with a thin insulation layer.

INDUSTRIAL APPLICABILITY

A simplification in an antenna structure and reduction in manufacturing cost can be realized because the antenna of the present invention can be placed in a narrow space and easily obtain a plurality of accurate resonant frequencies each which belongs to a separate frequency band.

The invention claimed is:

1. An antenna comprising:

a thin plate-like base member made of dielectric material;

a ground conductor formed of a thin-film shaped and rectangular conductor and disposed on the base member;

a first antenna element formed of a thin-film shaped and L-shaped conductor, having one end connected to one end of the ground conductor and disposed on the base member;

a second antenna element formed of a thin-film shaped and rectangular conductor and disposed on the base member without being directly connected to the ground conductor and the first antenna element;

a first connecting portion formed on the first antenna element in order to electrically connect the first antenna element to a first conductor of a cable;

a contact portion formed on the second antenna element in order to electrically connect the second antenna element to a second conductor of the cable via dielectric member; and a second connecting portion formed on the ground conductor in order to electrically connect the ground conductor to the second conductor of the cable.

2. The antenna according to claim 1, wherein a first resonance is generated by electric current distributed on the first antenna element and a second resonance is generated by electric current distributed on the second antenna element.

3. The antenna according to claim 1, wherein the ground conductor, the first antenna element, and the second antenna element are disposed on one surface of the base member.

4. The antenna according to claim 3, wherein a slit portion opening at a part thereof is formed on the base member by combining the ground conductor and the first antenna element and the second antenna element is disposed in the slit portion.

5. The antenna according to claim 1, wherein a thin insulation layer is covered over surfaces of the first antenna element except for the first connecting portion, the second antenna element and the ground conductor except for the second connecting portion.

6. The antenna according to claim 1, wherein the cable, the first conductor, the second conductor and the dielectric member are a coaxial cable, an inner conductor of the coaxial cable, an outer conductor of the coaxial cable and a sheath of the coaxial cable, respectively.

7. The antenna according to claim 6, wherein a film-like dielectric member is disposed between the contact portion and the sheath of the coaxial cable.

8. The antenna according to claim 1, wherein the base member has flexibility.

9. The antenna according to claim 8, wherein the ground conductor, the first antenna element and the second antenna element have flexibilities.

10. The antenna according to claim 9, further comprising: a support member made of non-conductor and fixedly securing the base member.

11. The antenna according to claim 10, wherein the support member comprises: an upper end portion extending to one direction; a lower end portion disposed in parallel to the upper end portion; and an interconnecting portion having one end vertically connected to one end of the upper end portion and the other end vertically connected to one end of the lower end portion.

12. The antenna according to claim 1, wherein the base member is mounted on a LCD section of a notebook-sized PC.

13. The antenna according to claim 1, wherein the base member is mounted on a corner area of a casing of a notebook-sized PC.

14. The antenna according to claim 1, wherein the ground conductor, the first antenna element and the second antenna element are formed on the base member by means of at least one of an etching technique and a screen printing technique.

15. The antenna according to claim 1, further comprising:

a support member having rigidity and fixedly securing the base member.

16. The antenna according to claim 15, wherein the base member is integrally formed with the support member.

17. The antenna according to claim 1, wherein set positions of the first connecting portion, the second connecting portion and the contact portion are independently arranged one another.

18. An antenna comprising:

a thin plate-like base member made of dielectric material;

a first antenna element formed of a thin-film shaped conductor and disposed on the base member so as to form a slit portion opening at a part thereof, the first antenna element having a first radiating portion, a second radiating portion disposed so as to be opposed to the first radiating portion, and an interconnecting portion connected to one end of the first radiating portion and one end of the second radiating portion;

a second antenna element formed of a thin-film and strip shaped conductor and disposed in the slit portion without being electrically connected to the first antenna element;

an impedance adjustment element formed of a thin-film and strip shaped conductor and disposed between the second radiating portion of the first antenna element and the second antenna element in the slit portion without being electrically connected to the first antenna element and the second antenna element;

a first connecting portion formed on the second radiating portion in order to electrically connect the second radiating portion of the first antenna element to a first conductor of a cable;

a first contact portion formed on the impedance adjustment element in order to contact the impedance adjustment element to the first conductor of the cable covered with a covering material;

a second connecting portion formed on the second antenna element in order to electrically connect the second antenna element to a second conductor of the cable; and a second contact portion formed on the first radiating portion in order to contact the first radiating portion of the first antenna element to the second conductor of the cable via a dielectric member.

19. The antenna according to claim 18, wherein a first resonance is generated by electric current distributed on the first antenna element, a second resonance is generated by electric current distributed on the second antenna element and impedance is adjusted corresponding to a shape and arrangement location of the impedance adjustment element.

20. The antenna according to claim 18, wherein the first antenna element, the second antenna element and the impedance adjustment element are disposed on one surface of the base member.

21. The antenna according to claim 20, wherein the first antenna element comprises: a first radiating portion formed in a strip shape; a second radiating portion formed in a strip shape and disposed in parallel to the first radiating portion; and an interconnecting portion having one end vertically connected to one end of the first radiating portion and the other end vertically connected to one end of the second radiating portion, the second antenna element is disposed between the first radiating portion and the second radiating portion and in parallel to the first radiating portion, and the impedance adjustment element disposed between the second radiating portion and the second antenna element and in parallel to the second radiating portion.

22. The antenna according to claim 21, wherein the first radiating portion is longer than the second antenna element and the second antenna element is longer than the second radiating portion and the impedance adjustment element.

23. The antenna according to claim 18, wherein a thin insulation layer is covered over surfaces of the first antenna element except for the first connecting portion, the second antenna element except for the second connecting portion and the impedance adjustment element.

24. The antenna according to claim 18, wherein the cable, the first conductor and the second conductor are a coaxial cable, an inner conductor of the coaxial cable and an outer conductor of the coaxial cable, respectively.

25. The antenna according to claim 18, wherein the base member has flexibility.

26. The antenna according to claim 25, wherein the first antenna element, the second antenna element and the impedance adjustment element have flexibilities.

27. The antenna according to claim 26, further comprising: a support member made of non-conductor and fixedly securing the base member.

28. The antenna according to claim 27, wherein the support member comprises: an upper end portion extending to one direction; a lower end portion disposed in parallel to the upper end portion; and an interconnecting portion having one end vertically connected to one end of the upper end portion and the other end vertically connected to one end of the lower end portion.

29. The antenna according to claim 18, wherein the base member is mounted on an LCD section of a notebook-sized PC.

30. The antenna according to claim 18, wherein the base member is mounted on a corner area of a casing of a notebook-sized PC.

31. The antenna according to claim 18, wherein the first antenna element, the second antenna element and the impedance adjustment element are formed on the base member by means of at least one of an etching technique and a screen printing technique.

32. The antenna according to claim 18, further comprising:

a support member having rigidity and fixedly securing the base member.

33. The antenna according to claim 32, wherein the base member is integrally formed with the support member.

34. The antenna according to claim 18, wherein set positions of the first connecting portion, the second connecting portion, the first contact portion and the second contact portion are independently arranged one another.

35. An antenna comprising:

a thin plate-like base member made of dielectric material;

a first antenna element formed of a thin-film shaped conductor and disposed on the base member so as to form a slit portion opening at a part thereof, the first antenna element having a first radiating portion, a second radiating portion disposed so as to be opposed to the first radiating portion, and an interconnecting portion connected to one end of the first radiating portion and one end of the second radiating portion;

a second antenna element formed of a thin-film and strip shaped conductor and disposed in the slit portion without being electrically connected to the first antenna element;

a first connecting portion formed on the second radiating portion in order to electrically connect the second radiating portion of the first antenna element to a first conductor of a cable;

a second connecting portion formed on the second antenna element in order to electrically connect the second antenna element to a second conductor of the cable; and a contact portion formed on the first radiating portion in order to contact the first radiating portion of the first antenna element to the second conductor of the cable via a dielectric member.

36. The antenna according to claim 35, further comprising: a first rear surface antenna element formed of a thin-film shaped conductor and disposed on the other surface of the base member so as to form a rear surface slit portion opening at a part thereof; and a second rear surface antenna element formed of a thin-film and strip shaped conductor, disposed in the rear surface slit portion and electrically connected to the second antenna element.

37. The antenna according to claim 36, wherein the first rear surface antenna element comprises: a first rear surface radiating portion formed in a slip-shape; a second rear surface radiating portion formed in a slip-shape and disposed in parallel to the first rear surface radiating portion; and a rear surface interconnecting portion connecting one end of the first rear surface radiating portion and one end of the second rear surface radiating portion, and the second rear surface antenna element is disposed between the first rear surface radiating portion and the second rear surface radiating portion and in parallel to the first rear surface radiating portion.

* * * * *